US005685228A

United States Patent [19]

Ehrlich et al.

[11] Patent Number: 5,685,228

[45] Date of Patent: Nov. 11, 1997

[54] BI-TRI-LEVEL DECK SYSTEM FOR A RAILCAR

[75] Inventors: Donald J. Ehrlich, Lafayette; Rodney P. Ehrlich, Monticello; Francis S. Smidler; DeWayne B. Williams, both of Lafayette, all of Ind.

[73] Assignee: Wabash National Corporation, Lafayette, Ind.

[21] Appl. No.: 536,832

[22] Filed: Sep. 27, 1995

[51] Int. Cl.[6] ..... B61D 3/00

[52] U.S. Cl. ..... 105/370; 410/26; 296/182

[58] Field of Search ..... 105/355, 370, 105/375, 4.2, 4.3; 296/181, 182; 410/26, 29.1

[56] References Cited

U.S. PATENT DOCUMENTS

| | | | |
|---|---|---|---|
| 1,083,831 | 1/1914 | Holdaway et al. | 105/370 |
| 1,514,211 | 11/1924 | Hester | 105/370 |
| 3,370,552 | 2/1968 | Poddesta et al. | 410/26 |
| 3,516,706 | 6/1970 | Bruce | 105/370 |
| 4,116,135 | 9/1978 | Jaekle et al. | 410/26 |
| 4,668,142 | 5/1987 | Fity et al. | 410/29.1 |
| 4,701,086 | 10/1987 | Thorndyke | 410/26 |
| 4,881,859 | 11/1989 | Ehrlich . | |
| 4,981,083 | 1/1991 | Cripe . | |
| 5,218,794 | 6/1993 | Ehrlich . | |
| 5,392,717 | 2/1995 | Hesch et al. | 105/375 |

FOREIGN PATENT DOCUMENTS

| | | | |
|---|---|---|---|
| 264731 | 4/1988 | European Pat. Off. | 105/4.2 |
| 2168020 | 1/1989 | United Kingdom . | |

*Primary Examiner*—Mark T. Le

*Attorney, Agent, or Firm*—Trexler, Bushnell, Giangiorgi & Blackstone, Ltd.

[57] ABSTRACT

A railcar which forms part of an articulated train includes a novel deck system and a novel, low-level, low-profile, no slack coupler. The railcar is formed from a floor, upstanding side walls which are connected to the floor and a top to form an enclosure. The deck system includes an upper deck and a lower deck which are connected together and are counterbalanced against each other. The decks are movable to a first position wherein the decks abut against each other so that cargo, such as automobiles, general freight and the like, can be loaded onto the upper deck and onto the floor. The decks are movable to a second position wherein the decks are spaced apart from each other so that cargo can be loaded onto the upper deck, the lower deck and the floor. In several embodiments of the novel deck system, the decks can be moved relative to the floor when the decks are in the first and second positions. The novel coupler attaches the railcars together and takes the form of a socket on a rear end of the railcar and a tongue on the front end of the railcar. A plurality of windows are provided on the top wall and in the decks to allow light to enter into the interior of the enclosure.

38 Claims, 10 Drawing Sheets

BI-TRI-LEVEL DECK SYSTEM FOR A RAILCAR

BACKGROUND OF THE INVENTION

This invention is generally directed to a novel railcar which, when connected to other like railcars, forms an articulated train for hauling cargo, such as general freight, automobiles, small trucks and the like. The railcars are connected together by a no slack coupling to form the articulated train. More particularly, the invention discloses embodiments of a novel deck system within the railcar. The deck system can be adjusted to provide two or three levels within the railcar for carrying cargo, such as general freight, automobiles, small trucks and the like, thereon. Moreover, the present invention discloses embodiments of the novel deck system which can further be adjusted to be positioned at a variety of heights with respect to the floor of the railcar to provide an efficient amount of space within the railcar depending on the type of cargo that is to be shipped.

In a conventional shipping procedure, when automobiles, trucks or the like are manufactured at a manufacturing plant, the automobiles must be loaded onto a trailer to transport the automobiles over the road. If the automobiles are to be shipped a great distance, to minimize costs, the automobiles are usually shipped by rail. After traveling by rail, in order to reach the final destination, such as the dealer's place of business, the automobiles are off-loaded from the train and reloaded onto another trailer which drives the automobiles to the final destination.

The railcars which are designed to transport and carry automobiles usually have a stationary deck therein so that an upper row of automobiles and a lower row of automobiles can be transported in a single railcar in an attempt to maximize th interior space of the railcar. The deck, however, is stationary and therefore, cannot be moved so that large sized loads can be accommodated within the railcar. As such, the transporting capability of the railcar is limited to carrying cargo which is the size of an automobile or smaller. General freight cannot be easily loaded or transported in this type of railcar since the interior of the railcar is encumbered by the deck.

In addition, the couplers which are used to connect the railcars together extend upwardly from the floor of each of the railcars into the interior space of each railcar and across the width of the front and back of the railcar. When loading the automobiles, if each automobile is driven through the train from the rear of the train to the front of the train, the automobile must be driven over the couplers. Sometimes, the space between the coupler and the deck is insufficient to allow the automobile to pass over the coupler. As a result, the roof of the automobile is often scratched, marred and/or dented by its contact with the deck, which damage must be fixed when the automobile reaches its final destination. This increases the dealer's cost and the ultimate cost to the purchaser.

The novel railcar of the present invention is intended to prevent or minimize these problems, as well as to present several improvements and advantages over prior art railcars.

OBJECTS AND SUMMARY OF THE INVENTION

A general object of the present invention is to provide a railcar which, when connected to other like railcars, forms an articulated train.

Another general object of the present invention is provide a novel railcar which is connected to other like railcars by a no slack coupling to form an articulated train.

Yet another general object of the present invention is to provide a novel railcar having a novel deck system therein which can be adjusted to provide a single level, a bi-level deck system or a tri-level deck system for efficiently transporting general freight, automobiles, small trucks or the like.

An object of the present invention is to provide an articulated train in which cargo, such as general freight, automobiles, small trucks or the like, can be easily and quickly loaded.

A further object of the present invention to provide a novel railcar which, when connected to other like railcars, forms a unit in an articulated train, each such railcar having a low-level, low-profile coupler to provide a level surface between railcars so that automobiles or the like can be easily loaded and unloaded from the articulated train.

Briefly, and in accordance with the foregoing, the present invention discloses a railcar which, when connected to other like railcars, forms an articulated train for transporting cargo, such as automobiles, small trucks, general freight and the like. The railcar includes a floor, upstanding side walls which are connected to the floor and a top to form an enclosure. A landing gear, which has a railworthy, flanged wheel thereon, is mounted beneath the underside of the railcar along a front portion thereof, and a railway bogie is mounted beneath the underside of the railcar along a rear portion thereof.

A novel deck system is housed within the body structure and includes an upper deck and a lower deck which are connected and counterbalanced against each other such that movement of the upper deck in an upward direction causes movement of the lower deck in a downward direction and movement of the upper deck in an downward direction causes movement of the lower deck in an upward direction. The decks are movable to a first position such that the decks abut against each other so that cargo can be loaded onto the upper deck and onto the floor. The decks are movable to a second position such that the upper and lower decks are spaced apart from each other and the lower deck is spaced from the floor such that cargo can be loaded onto the upper deck, the lower deck and the floor. In some embodiments, he decks can be moved relative to the floor of the railcar when the decks are in the first position or in the second position.

In addition, when the decks are in the first position, the abutting decks can be raised so as to be lowered so as to rest on the floor of the railcar. In this position, the interior space of the railcar is generally unencumbered by the decks and the deck system so that general freight can be easily loaded into the railcar.

A novel, low-level, low-profile, no slack coupler is provided for attaching the railcar to adjacent railcars. The no slack coupler is formed from a tongue which is attached to the front end of the railcar and a socket which is formed within the rear end of the railcar. To connect the railcars together, the tongue on the front end of each of the railcars is held within a corresponding socket in the rear end of the adjacent railcar. The socket is formed in a casting which protrudes upwardly above the level of the floor to a height which is less than the distance between the floor and the underside of most automobiles. The casting is positioned along generally a centerline of the railcar and is spaced from the side walls of the railcar a predetermined distance.

To attach the railcar to other railcars or the like, the front end of the forwardmost railcar is attached to a railroad bogie by engaging the front tongue on the forwardmost railcar within a casting on the bogie and securing the tongue therein by suitable means. A knuckle coupler plug is attached to a casting on top of the bogie and can be detached therefrom and extends forwardly from the bogie. The rearmost railcar has a knuckle coupler plug attached within the rear socket, which knuckle coupler plug can be detached therefrom. To attach the unit to the remainder of the articulated train, the knuckle coupler plug attached to the bogie is engaged within a socket in the railcar thereahead and the knuckle coupler plug attached to the socket in the rearmost railcar is attached to a railroad bogie which is connected to the railcar therebehind.

To load the train with cargo, the automobiles, small trucks, a forklift carrying cargo or the like is driven from the rear end of the train to the front end of the train. The cargo passes from railcar to railcar across deck plates which span the gap between the railcars. The cargo can be driven easily through the train because the tires of the automobiles, truck or forklift straddle the no slack coupler as the cargo passes thereover. Cargo can be loaded onto the decks and onto the floor of the train at the same time to quickly and efficiently load the train.

In addition, a prime mover, such as a tractor, can be connected to the front end of the railcar by engaging the front tongue in a casting on the prime mover. A dolly adaptor can be attached to a rear end of the railcar so that the railcar can be moved off of a railroad track and around a rail yard.

To remove an individual railcar from the articulated train, so that it can be loaded or unloaded, the landing gear on the railcar which is to be removed is extended so that the flanged wheel comes into contact with the railroad track. The no slack couplers are detached from the front and rear of the railcar to release the railcar from the remainder of the unit and train. Subsequently, the railcars which are forward and backward of the detached railcar are moved relative to the detached railcar. A tractor is backed up so that the tractor can be connected to the detached railcar.

Next, a dolly adaptor is attached to the rear end of the railcar and the landing gear is retracted. The dolly adaptor has structure thereon, such as an air bag, which can be expanded or inflated to raise the back end of the railcar until the rail bogie attached to the rear end of the railcar does not contact the railroad tracks. Thereafter, the railcar can be driven around the rail yard via the tractor and the dolly adaptor, so that it can be backed up to a dock and loaded. More than an individual railcar can be released from the train and moved around the rail yard.

The railcar can be easily reattached within the train by carrying out the opposite steps.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT

Figure 1:
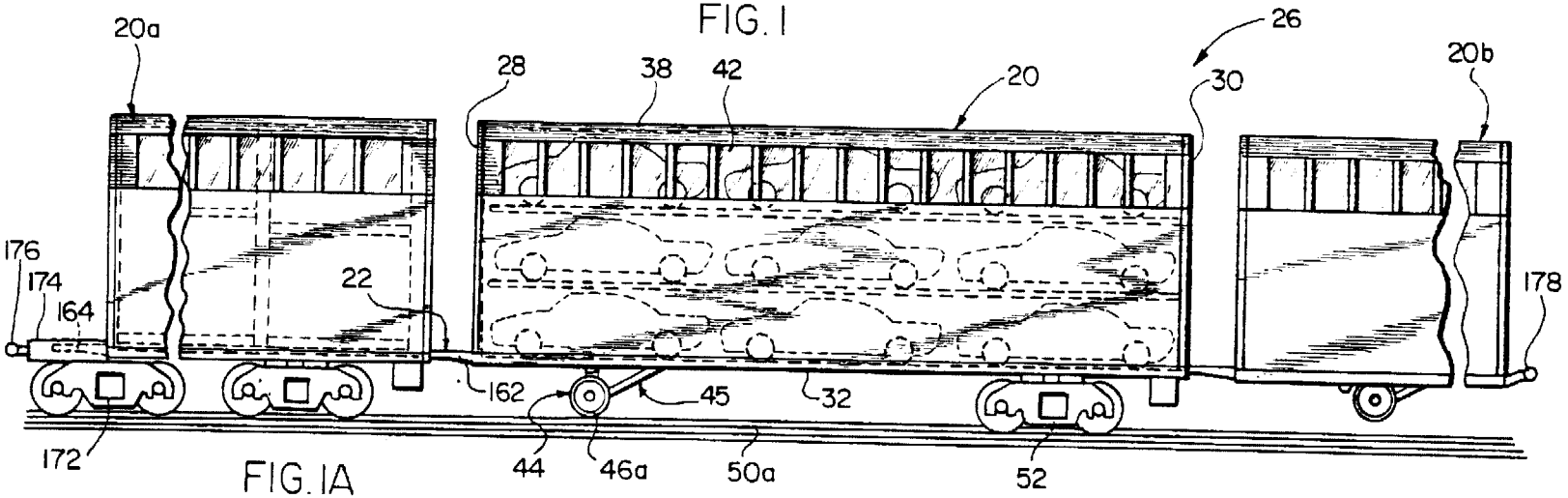
FIG. 1 is a schematic, side elevational view of a unit which can be connected to other like units to form an articulated train, such unit including a plurality of railcars each connected together by a no slack coupler, each railcar incorporating the features of the invention and having a novel deck system housed therein which carries cargo thereon, such cargo being a plurality of automobiles, such deck system and automobiles being illustrated schematically and in phantom lines.
Figure 2:
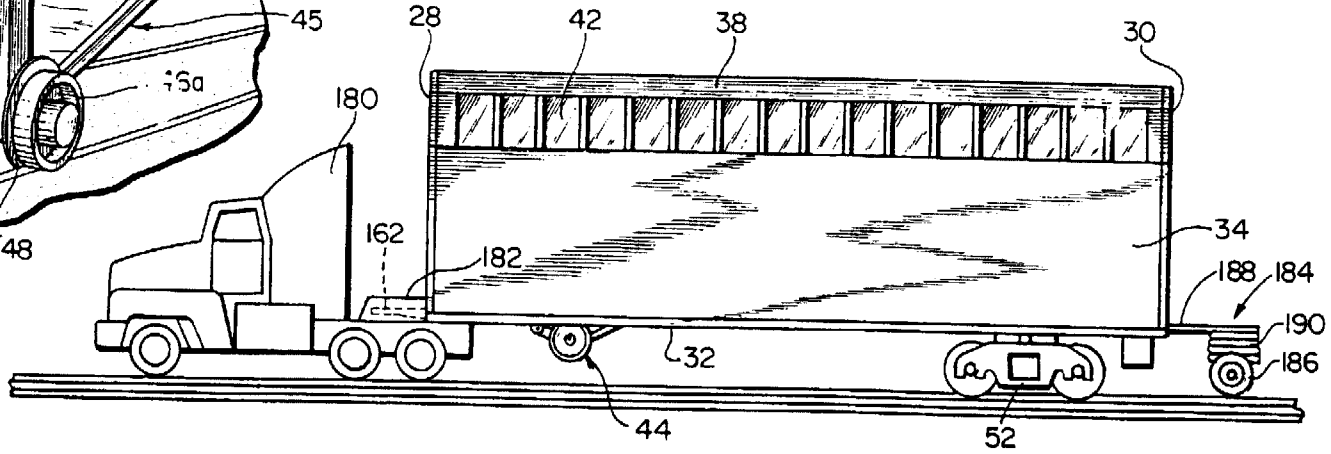
FIG. 2 is a side elevational view of an individual railcar which has been detached from the remaining railcars in the unit, such railcar having a prime mover and a dolly adaptor attached thereto while the railcar is still on the railroad tracks.

While the invention may be susceptible to embodiment in different forms, there is shown in the drawings, and herein will be described in detail, illustrative embodiments with the understanding that the present disclosure is to be considered an exemplification of the principles of the invention, and is not intended to limit the invention to that as illustrated and described herein.

The present invention discloses a railcar 20 having a variety of novel features therein including a novel low-level, low-profile, no slack coupler 22 and a novel bi-level, tri-level deck system 24. The railcar 20, when connected to other like railcars, forms a unit 26 which can be attached to other railcars, or other units or the like to form an articulated train. The railcars 20 can be used to haul automobiles, small trucks or the like or general freight. Each railcar 20 may be a freight car or a box car, or alternatively, each railcar 20 may be a bimodal trailer.

Each railcar 20 is formed from a frame having top and bottom rails. Each railcar 20 has a front end 28, a rear end 30, a floor 32, a pair of upstanding side walls 34, 36 which extend upwardly from opposite sides of the floor 32 and a ceiling or top wall 38 which is connected to the upper ends of the side walls 34, 36 to close the top of the railcar 20 to form an enclosure. Each side wall 34, 36 includes a plurality of side posts and are formed of a suitable material.

The front and rear ends 28, 30 of each railcar 20 have a door structure (not shown) attached thereto which completely closes the front and rear ends 28, 30 of the railcar 20 when the door structure is closed and completely opens the front and rear ends 28, 30 of the railcar 20 when the door structure is open to provide unobstructed access into the interior of the railcar 20 through the ends 28, 30 of the railcar 20. Such a door structure may be made in accordance with the novel door structure disclosed in co-pending U.S. patent application Ser. No. 08/533869 now U.S. Pat No. 5,601,033 entitled "Door Structure For A Railcar In An Articulated Train" which was filed on Sep. 25, 1995 and is commonly owned by the assignee herein, and which disclosure is herein incorporated by reference. Each railcar 20 may have a conventional door (not shown) on the side of the railcar 20 to load cargo therethrough.

Figure 6:
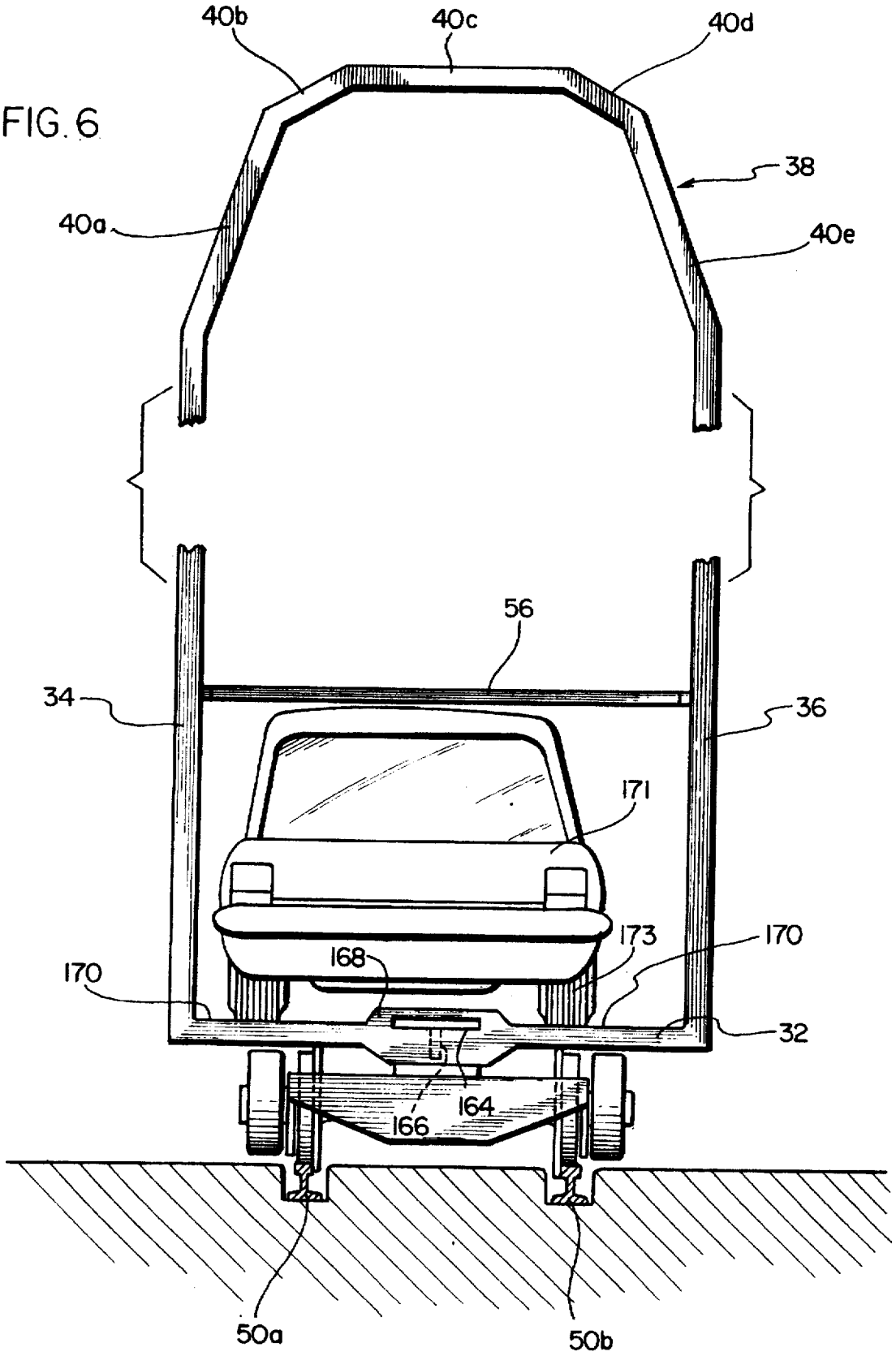
FIG. 6 is a partial, rear elevational view of the railcar showing the position of an automobile within the railcar and underneath the lower deck.

As best illustrated in FIG. 6, the top wall 36 of each railcar 20 is formed from five panels **40*a*, 40*b*, 40*c*, 40*d*, 40*e*. The uppermost panel 40*c* is horizontal and is perpendicular to the side walls 34, 36. The outermost panels 40*a*, 40*e* are connected to the upper ends of the side walls 34, 36 at the top rail and are angled at a severe angle relative to the horizontal plane. The inner panels 40*b*, 40*d* are angled relative to the panels 40*a*, 40*e* and are angled relative to the top panel 40*c* and respectively connect the panels 40*a*, 40*e* and the top panel 40*c* together. The inner panels 40*b*, 40*d* are angled at a less severe angle relative to the horizontal than the angle at which the outermost panels 40*a*, 40*e* are angled relative to the horizontal. The ceiling panels 40*a–e* provides the railcar 20 with a maximum amount of interior cargo space while allowing for the proper clearance envelope required by current tunnels. It is envisioned that the top wall 36 of each railcar 20** could be flat.

The panels **40*a* and 40*e* have a plurality of light transmitting windows 42 along the length thereof. The windows 42 allow light to enter into the interior space within the railcar 20. Each window 42 is made of a suitable material that is shatter resistant, preferably clear fiberglass. It is important that the window material resists shattering so that damage is prevented to the cargo inside the railcar 20 by outside objects which are dropped onto the top of the railcar 20. In addition, because the windows 42 are angled relative to the side walls 34, 36 and to the top panel 40*c* and because the angled panels 40*b*, 40*d* are provided, if material is dropped onto the railcar 20 from an overpass, such as a vandal dropping a brick or a rock onto the railcar 20, the angle at which the windows 42 are disposed deters the material from contacting the windows 42**.

Figure 1A:
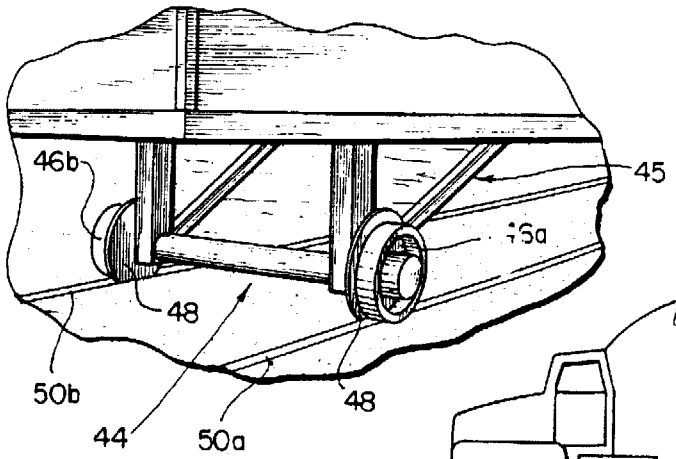
FIG. 1A is a perspective view of a landing gear attached to the underside of one of the railcars shown in FIG. 1, such landing gear having a pair of flanged wheels attached thereto and being in an extended position so that the flanged wheels engage railroad rails.

As shown in FIG. 1A, an extendable and retractable landing gear 44 is mounted beneath the underside of each railcar 20 proximate to the front end 28 of the railcar 20. The landing gear 44 has structure 45, which may be comprised of a plurality of struts that can be moved relative to the underside of the railcar 20, for extending and retracting a pair of railworthy wheels **46*a*, 46*a* from underneath the railcar 20. Each wheel 46*a*, 46*b* is rotatable with respect to the structure 45 and has a flange 48 thereon. Each flanged wheel 46*a*, 46*b* is used to engage one of the railroad rails 50*a*, 50*b* when the landing gear 44 is extended for reasons described herein in detail. The flange 48 engages the side of the rail 50*a*, 50*b* and prevents the respective wheel 46*a*, 46*b* from becoming laterally disengaged from the rail 50*a*, 50*b***.

A railroad bogie 52 is mounted beneath the underside of each of the railcars 20 proximate to the rear end 30 of the railcar 20 and along a rear portion thereof. It is to be noted that the bogie 52 is not shared by two railcars 20 and instead, each railcar 20 has a bogie 52 which supports its rear end. The bogie 52 may be made in accordance with the bogie disclosed in U.S. Pat. No. 4,981,083 which disclosure is herein incorporated by reference. Each such bogie 52 has a brake thereon so that the railcars 20 can be individually braked. In addition, the bogie 52 is bi-directional. That is, the bogie 52 is capable of being moved forward or backward on the railroad tracks.

Figure 13:
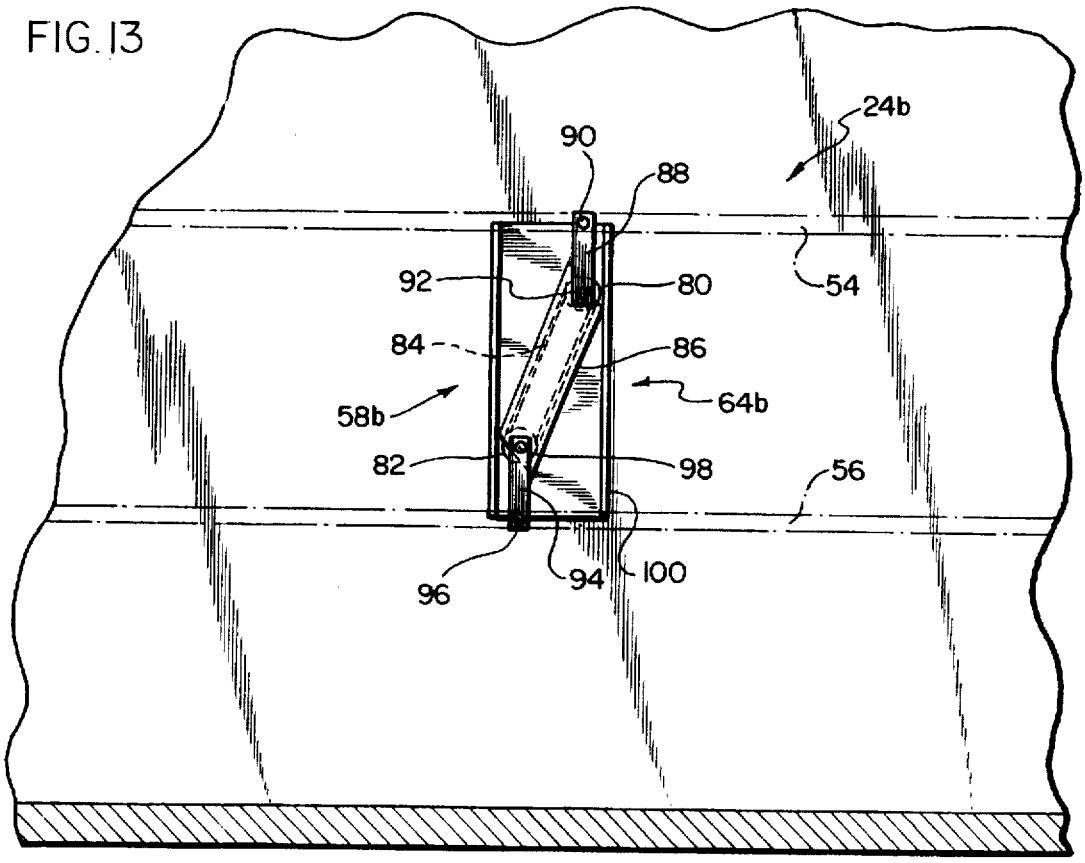
FIG. 13 is a side elevational view of a second embodiment of a novel deck system in accordance with the present invention in a spaced apart arrangement to provide a tri-level deck so that cargo can be loaded on the upper deck, the lower deck and the floor.
Figure 14:
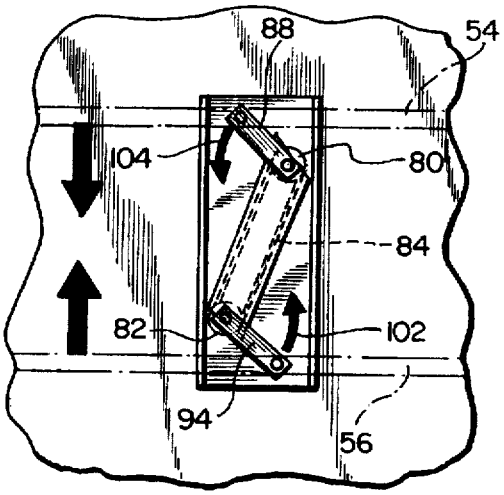
FIG. 14 is a side elevational view of the deck system shown in FIG. 13 wherein the upper deck and the lower deck are in the process of being moved together.
Figure 15:
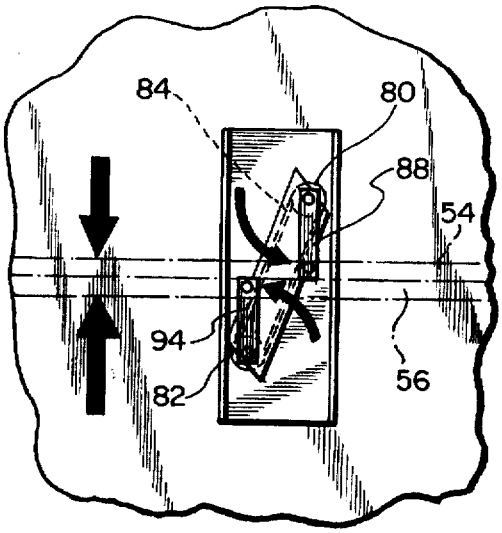
FIG. 15 is a side elevational view of the deck system shown in FIG. 13 wherein the upper deck and the lower deck abut against each other to provide a bi-level deck so that cargo can be loaded on the upper deck and the floor.
Figure 16:
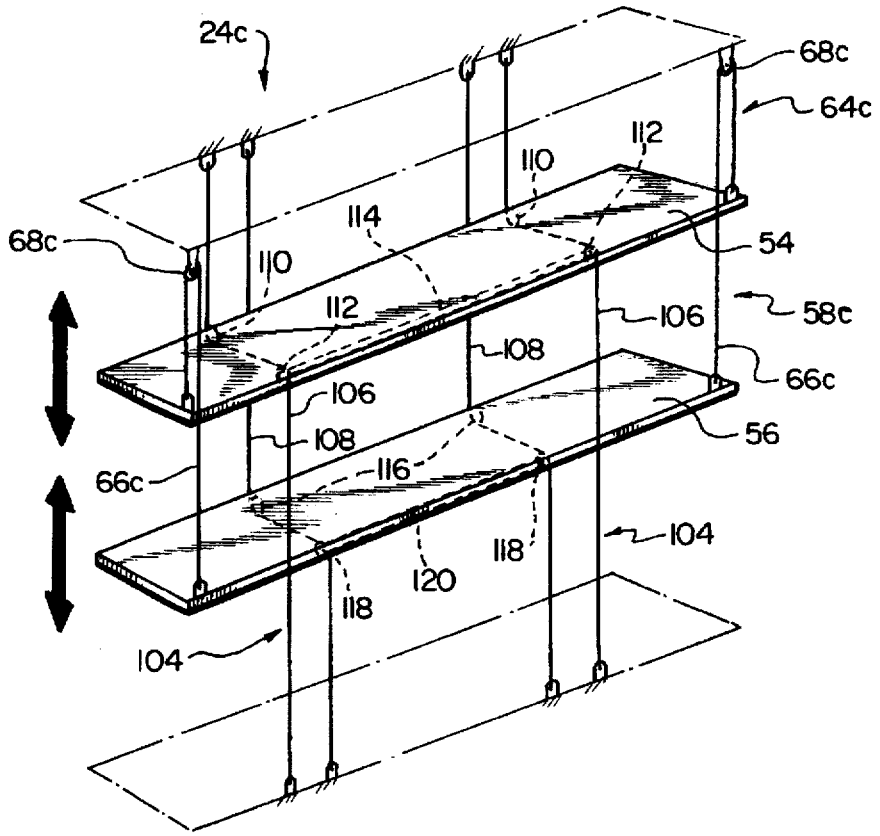
FIG. 16 is a schematic view of a third embodiment of a novel deck system in accordance with the present invention in a spaced apart arrangement to provide a tri-level deck so that cargo can be loaded on the upper deck, the lower deck and the floor.
Figure 17:
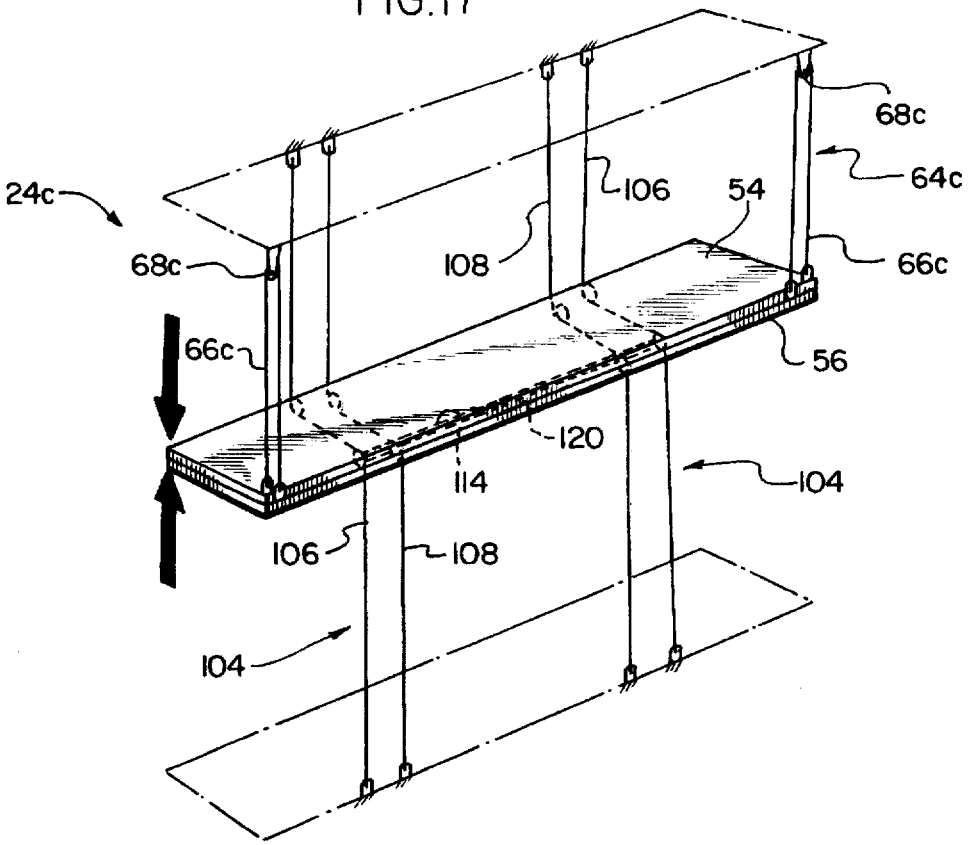
FIG. 17 is a schematic view of the deck system shown in FIG. 16 wherein the upper deck and the lower deck abut against each other to provide a bi-level deck so that cargo can be loaded on the upper deck and the floor.
Figure 18:
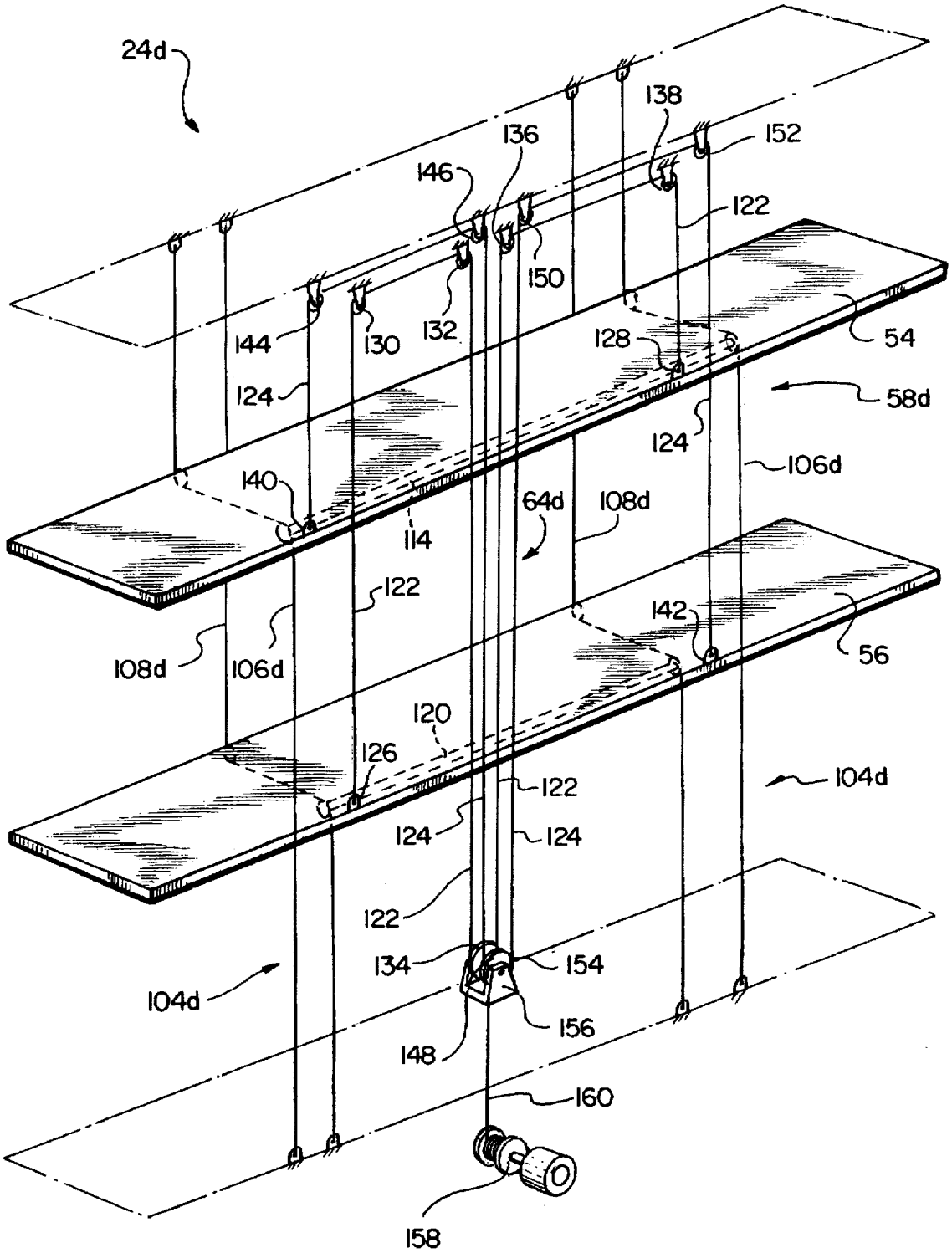
FIG. 18 is a schematic view of a fourth embodiment of a novel deck system in accordance with the present invention in a spaced apart arrangement to provide a tri-level deck so that cargo can be loaded on the upper deck, the lower deck and the floor.
Figure 20:
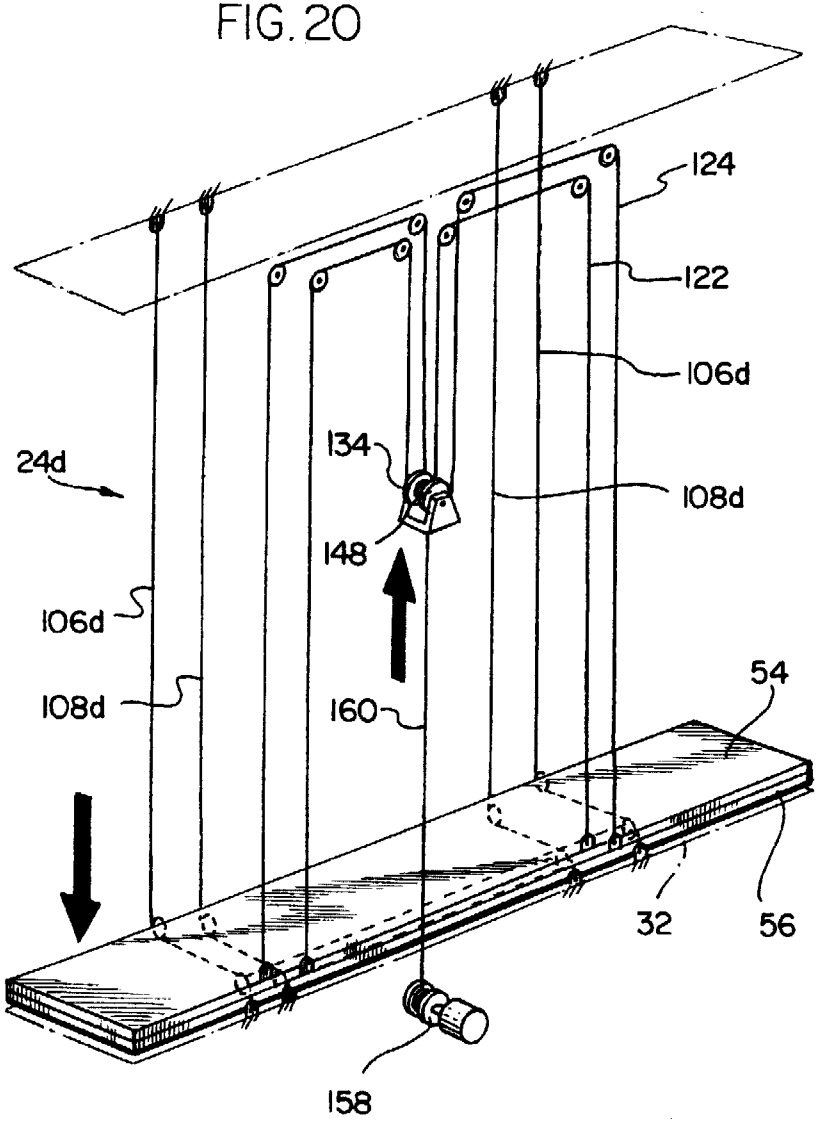
FIG. 20 is a schematic view of the deck system shown in FIG. 18 wherein the decks are in an abutting position and have been moved so as to lie on the floor of the railcar by an adjustable support mechanism.
Figure 19:
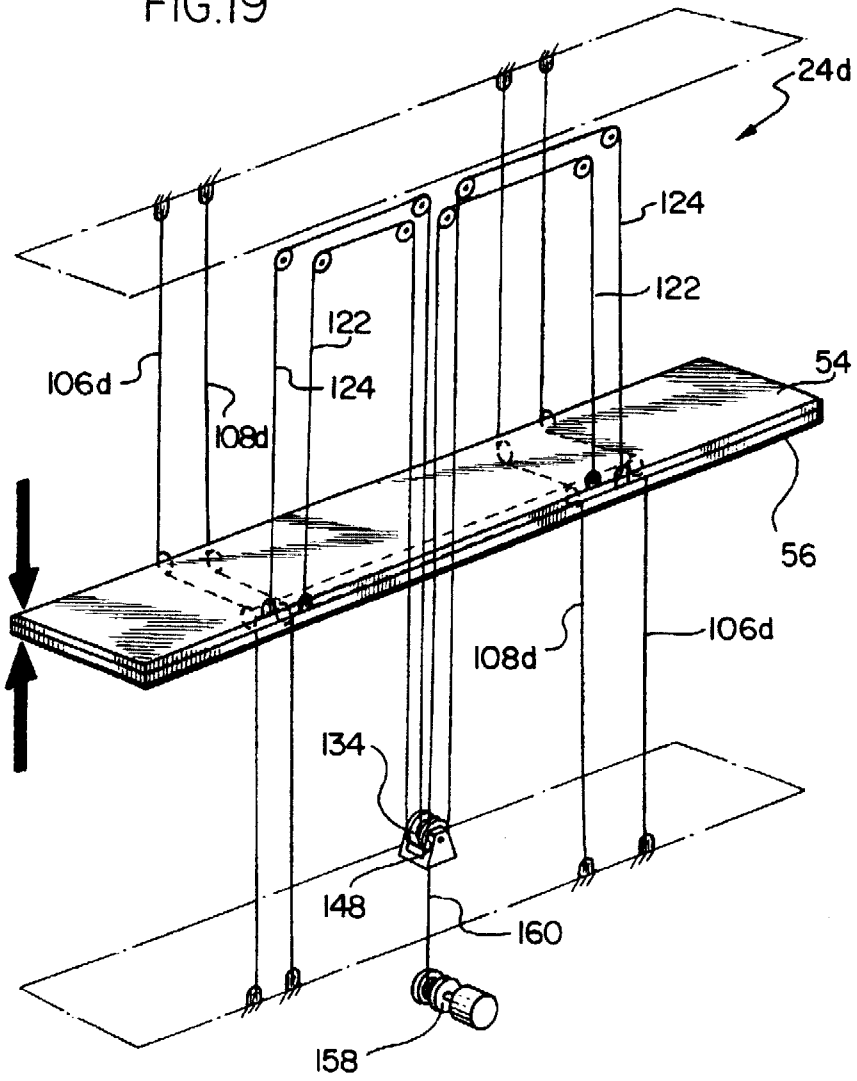
FIG. 19 is a schematic view of the deck system shown in FIG. 18 wherein the upper deck and the lower deck abut against each other to provide a bi-level deck so that cargo can be loaded on the upper deck and the floor.

The novel deck system 24 of the present invention is housed within each railcar 20 and is used to carry cargo, such as general freight, automobiles, small trucks or the like. A first embodiment of the deck system 24 is shown in FIGS. 7–11. A second embodiment of the deck system **24*b* is shown in FIGS. 13–15; a third embodiment of the deck system 24*c* is shown in FIGS. 16 and 17 and a fourth embodiment of the deck system 24*d* is shown in FIGS. 18–20. Like elements in each embodiment are denoted by like reference numerals with the like elements in the second embodiment having a "b" after the numeral; ones in the third embodiment having a "c" after the numeral and ones in the fourth embodiment having a "d" after the numeral. The generalities of the embodiments of the deck system are described with respect to the first embodiment of the deck system 24** for ease in description.

Generally, the deck system 24 includes an upper deck 54 and a lower deck 56 which are connected together by an adjustable support structure 58. The decks 54, 56 can be moved to a variety of positions within the railcar 20. The decks 54, 56 can be moved to form a single level deck arrangement, a bi-level deck arrangement or a tri-level deck arrangement. The decks 54, 56, after moved to the desired arrangement, can hold the cargo, such as automobiles, trucks, general freight, thereon.

The decks 54, 56 are substantially the same size such that the upper deck 54 completely overlies the lower deck 56 and each of the decks 54, 56 is approximately the same size as the interior of the enclosure. Preferably, the decks 54, 56 are solid, that is, there are no apertures through the decks 54, 56. Because the decks 54, 56 are solid, this prevents any run-off from the automobiles, trucks or the like loaded onto one or both of the decks 54, 56 onto the cargo loaded in the railcar 20 thereunder.

Figure 3:
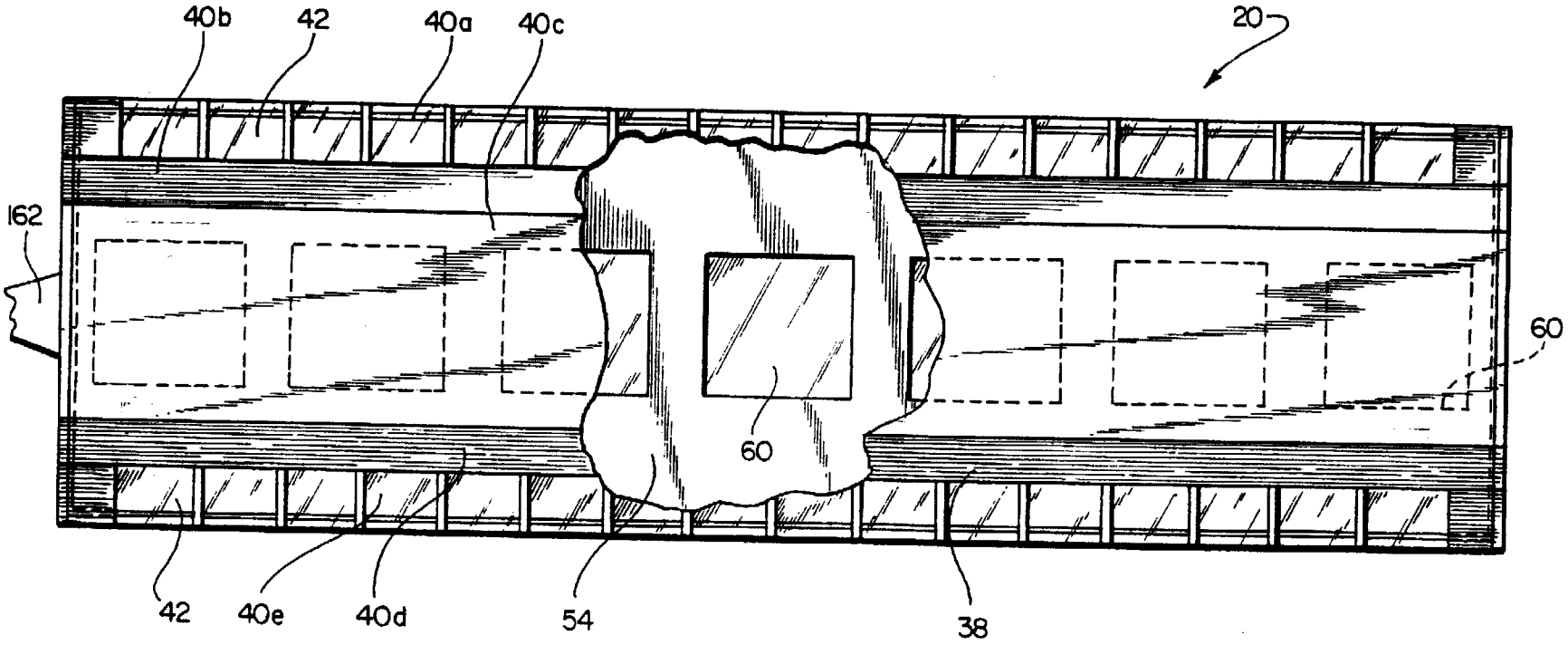
FIG. 3 is a top elevational view of an individual railcar, partially broken away to show the deck element therein.

As shown in FIG. 3, a plurality of light-transmitting windows 60 are provided in the decks 54, 56 along the length thereof. The windows 60 are preferably provided along the middle of the decks 54, 56 and are flush with the remainder of the deck 54, 56. The windows 60 allow the light which passes through the windows 42 in the top wall 38 to pass through the decks 54, 56 so as to illuminate the interior of the enclosure even when the end doors are closed. Light does not pass through the remainder of the enclosure due to the opaqueness of the walls. The windows 60 in the decks 54, 56 are made of a suitable shatter resistant material, preferably clear fiberglass.

Figure 12:
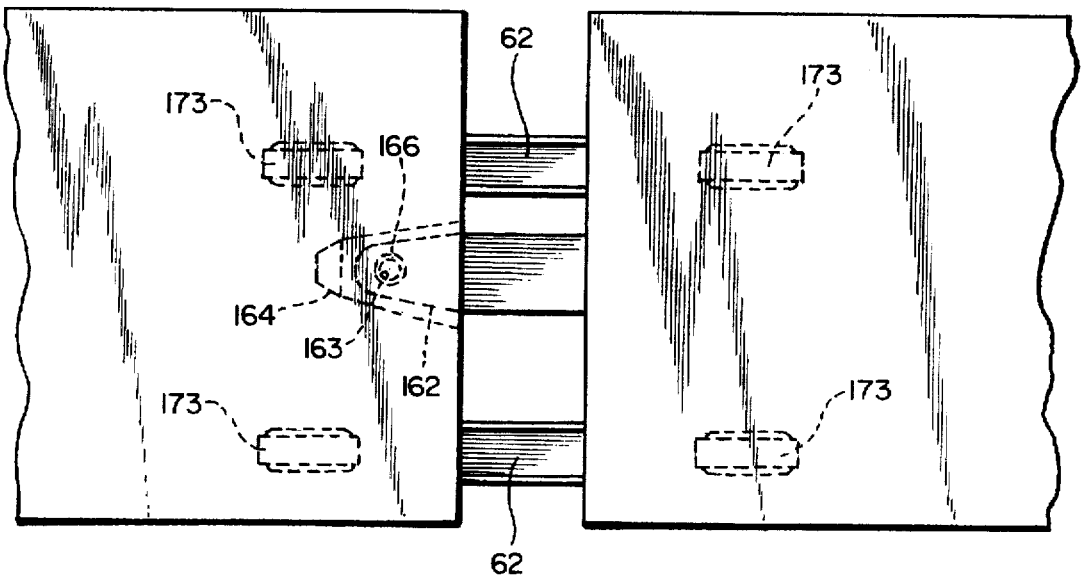
FIG. 12 is a top elevational view of two connected railcars showing a novel, low-level, low-profile coupler between the railcars, and showing the tires of an automobile which is being loaded into the unit such that the automobile straddles the coupler.

A pair of deck plates or bridge plates 62 are attached to the floor 32 and the upper and lower decks 54, 56. The deck plates 62, as shown in FIG. 12, are used to provide a bridge between two adjacent railcars 20 so that the automobile, small truck, forklift carrying the general freight or the like can be driven between the adjacent railcars 20 in the articulated train from one end of the train to the opposite end of the train. The deck plates 62 are preferably attached to the front end of the decks 54, 56 and the floor 32 of each railcar 20. Alternatively, one such deck plate 62 can be provided on the preceding railcar and the other such deck plate 62 can be provided on the following railcar, if desired. The deck plates 62 can flip up, slide in, or the like, relative to the floor 32 and the decks 54, 56 so as to keep the deck plates 62 out of the way when not in use.

Attention is now directed to the specifics of the first embodiment of the deck system 24 as shown in FIGS. 7–11. The upper and lower decks 54, 56 of the novel deck system 24 are connected together by the adjustable support structure 58 and counterbalanced against each other such that movement of the upper deck 54 in an upward direction causes movement of the lower deck 56 in a downward direction and movement of the upper deck 54 in a downward direction causes movement of the lower deck 56 in an upward direction. In addition, once the decks 54, 56 are moved together or apart relative to each other, the decks 54, 56 can be moved relative to the floor 32 of the railcar 20 to provide an even further variety of positions at which the decks 54, 56 can be positioned within the railcar 20.

Figure 7:
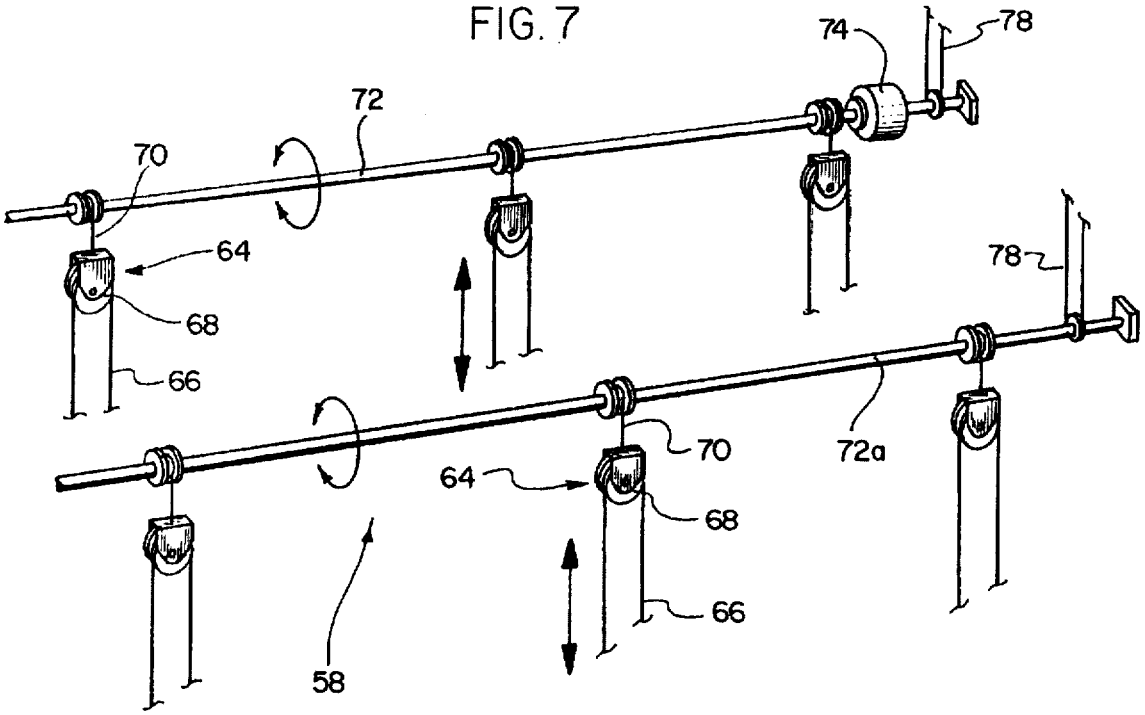
FIG. 7 is a schematic view of a first embodiment of an adjustable support structure in accordance with the present invention for moving a novel deck system housed within the railcar to various positions.

The adjustable support structure 58 shown in the first embodiment of the novel deck system 24 is schematically illustrated in FIG. 7. In order to allow the decks 54, 56 to move relative to each other, the decks 54, 56 are connected to each other by a plurality of counterbalancing structures 64 on each side the decks 54, 56. Each counterbalancing structure 64 includes a flexible, non-extendable connecting element 66, such as a chain, and a sprocket 68. Each sprocket 68 is adjacent to a side wall 34, 36. The chain 66 extends around or is looped around the sprocket 68. One end of each chain 66 is connected to the upper deck 54; the chain 66 extends around one of the sprockets 68, and the opposite end of the chain 66 is connected to the lower deck 56. The ends of each chain 66 are connected to the decks 54, 56 by suitable means. The decks 54, 56 are counterbalanced against each other such that the lower deck 56 only needs to be pushed down manually to cause the upper deck 54 to move upwardly and similarly, the lower deck 56 only needs to be pushed upwardly manually to cause the upper deck 54 to move downwardly.

Once the decks 54, 56 are spaced apart from each other or in an abutting position, the decks 54, 56 can be moved relative to the floor 32 of the railcar 20. As shown in FIG. 7, each sprocket 68 which is adjacent to the side wall 34 is attached by a casing to a second connecting element 70, such as a chain, that is wound around an elongated shaft 72. Similarly, each sprocket 68 which is adjacent to the side wall 36 is attached by a casing to a like second connecting element 70, such as a chain, that is wound around a like elongated shaft **72*a*. Each shaft 72, 72*a* extends generally the length of the railcar 20 and is mounted by suitable means proximate to the upper ends of the respective side walls 34, 36. The shaft 72*a* is connected to an electric motor 70 which is used to rotate the shaft 72**.

A suitable mechanism 76 is provided to join the shafts 72, **72*a* together and to rotate the shafts 72, 72*a* at the same speed so that the opposite sides of the decks 54, 56 are lowered at the same rate to preventing the decks 54, 56 from tipping. Such a mechanism 76 may take the form of an endless chain 78 that is attached to the front ends of the shafts 72, 72*a*. The endless chain 78 follows the outline of the top wall 38 for reasons described herein. The endless chain 78 is connected to the top wall 38** by suitable means, such as sprockets (not shown).

Thus, to lower the decks 54, 56 once they are moved to the desired position relative to each other by use of the counterbalancing structure 64, the motor 74 is activated by suitable control means to rotate the shaft 72. Rotation of shaft 72 causes the endless chain 78 to rotate relative to shaft 72 to cause shaft **72*a* to rotate. The rotation of the shafts 72, 72*a* causes the chains 70 to unwind from or to wind around the shaft 72, 72*a* depending on which way the shafts 72, 72*a* are rotated. Thus, the chains 70 lengthen or shorten to respectively lower or raise the decks 54, 56**.

FIGS. 8–11 illustrate various positions in which the decks 54, 56 in the deck system 24 can be positioned by using the adjustable support structure 58. The details of the adjustable support structure 58, as described above are not shown for purposes of clarity. It is to be understood that the positions of the upper and lower decks 54, 56 shown in FIGS. 8–11 are merely illustrative of possible positions in which the novel deck system 24 of the present invention can be positioned. In addition, it is to be understood that the positioning of the decks 54, 56 relative to each other is dictated by the length of the chain 66. Thus, by varying the length of chain 66, a multitude of relative positions can be achieved.

Figure 8:
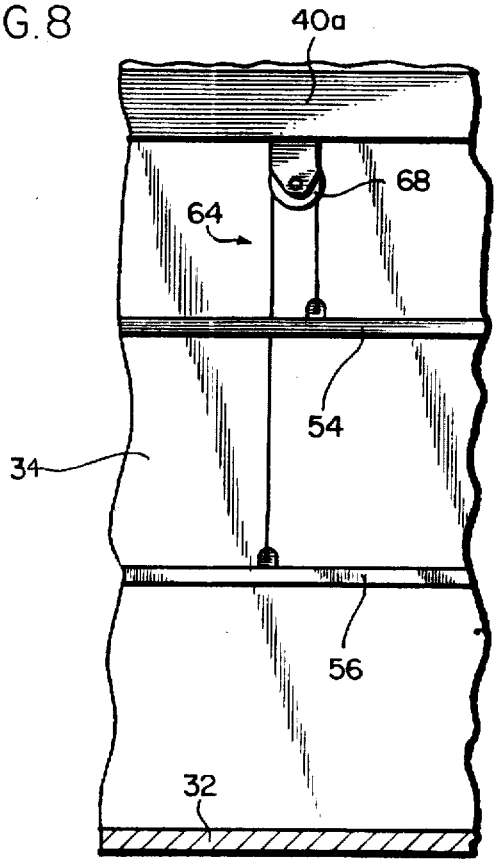
FIG. 8 is a schematic view of the deck system which has been moved to provide a tri-level deck arrangement by the adjustable support structure shown in FIG. 7 so that cargo can be loaded on the upper deck, the lower deck and the floor.
Figure 9:
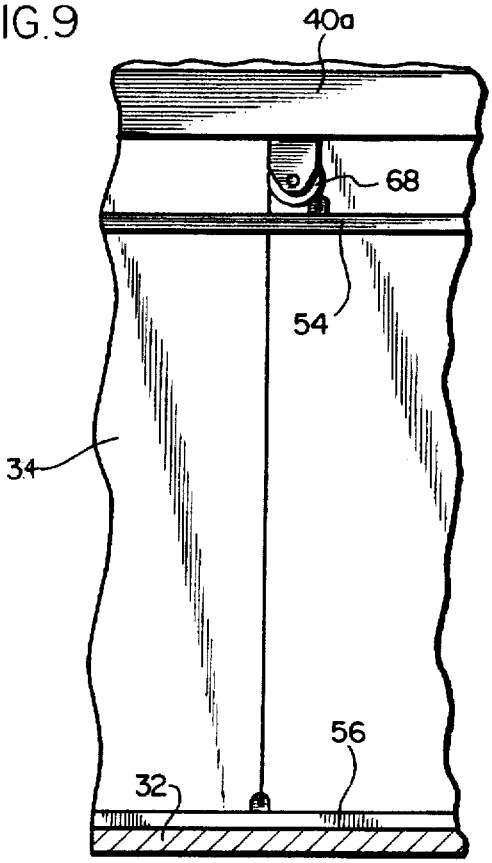
FIG. 9 is a schematic view of the deck system in a spaced apart arrangement which has been moved to provide a bi-level deck arrangement by the adjustable support structure shown in FIG. 7.
Figure 10:
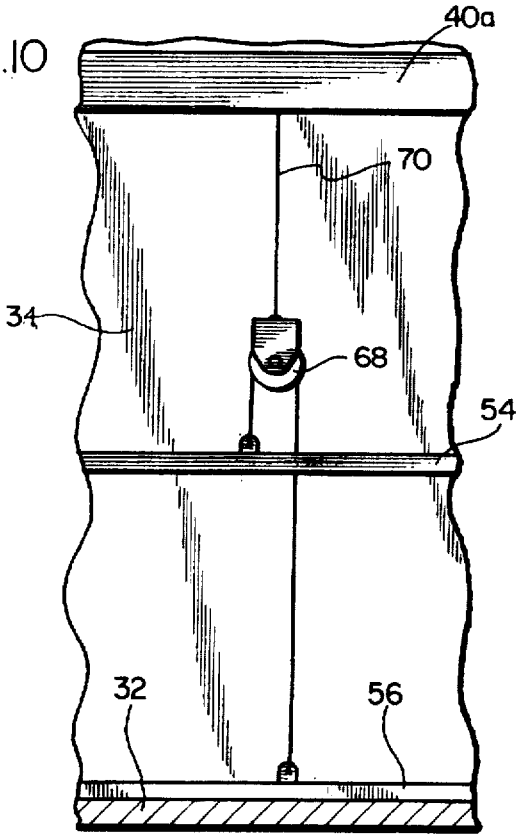
FIG. 10 is a schematic view of the deck system in a spaced apart arrangement which has been moved to provide a bi-level deck arrangement by the adjustable support structure shown in FIG. 7 so that cargo can be loaded on the upper deck and the lower deck which is resting on the floor.
Figure 11:
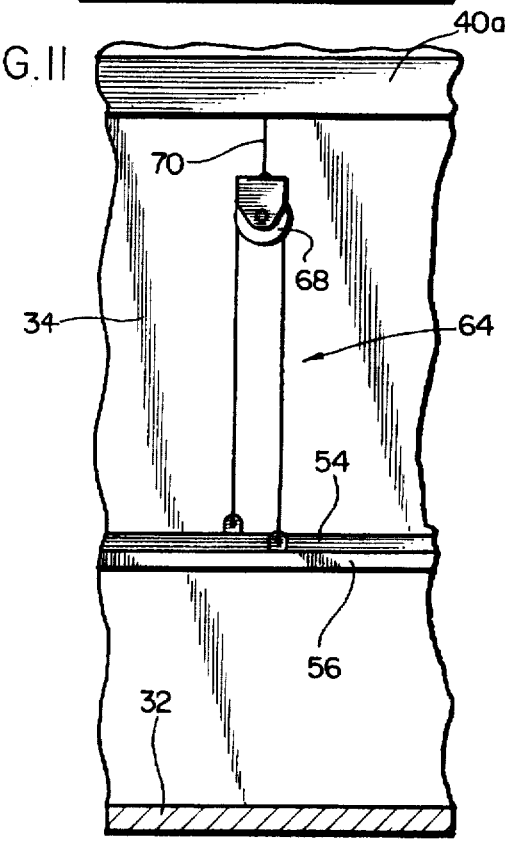
FIG. 11 is a schematic view of the deck system wherein the upper deck and the lower deck have been moved by the adjustable support structure shown in FIG. 7 so as to abut against each other to provide a bi-level deck so that cargo can be loaded on the upper deck and the floor.

As illustrated in FIG. 8, the upper deck 54 is spaced from the lower deck 56 such that a tri-level deck arrangement is provided. Cargo can be loaded on top of the upper deck 54, the lower deck 56 and the floor 32. As shown in FIG. 9, the upper and lower decks 54, 56 are split apart from each other. The upper deck 54 is proximate to the top of the side walls 34, 36 and the lower deck 56 is resting on the floor 32 such that the lower deck 56 becomes part of the floor 32. FIG. 10 illustrates one form of a bi-level deck arrangement. The upper deck 54 is positioned at approximately the midpoint of the side walls 34 and the lower deck 56 is resting on the floor 32 of the railcar 20. Cargo can be loaded onto the upper deck 54 and onto the floor 32 of the railcar 20. FIG. 11 shows the decks 54, 56 in an abutting relationship and positioned slightly below the midpoint of the side walls 34. This positioning of the decks 54, 56 also illustrates a form of a bi-level deck arrangement. Cargo can be loaded onto the upper deck 54 and onto the floor 32.

It is to be noted that in FIGS. 10 and 11, the decks 54, 56 have been positioned in the desired position relative to each other and have been moved relative to the floor 32 of the railcar 20 by the adjustable support structure 58 as described hereinabove. When the decks 54, 56 are in an abutting position, such as that shown in FIG. 11, the abutting decks 54, 56 can be moved so as be positioned so as to rest on the floor of the railcar 20. When resting on the floor 32, a forklift can easily load general freight onto the upper deck 54 since the interior cargo space of the railcar 20 is generally unencumbered by the deck system 24, i.e. the deck system 24 does not enter into the space occupied by the general freight.

Attention is now directed to the second embodiment of the novel deck system **24*b* as shown in FIGS. 13–15. In this embodiment of the deck system 24*b*, the decks 54, 56 can only be moved between two positions and are counterbalanced against each other. One position, as shown in FIG. 13, provides the tri-deck arrangement. The other position, as shown in FIG. 15, provides the bi-deck arrangement. Once the decks 54, 56 are moved to the desired position relative to each other, the decks 54, 56 cannot be moved relative to the floor 32 of the railcar 20 as can be effected in the first embodiment of the deck system 24**.

In this embodiment of the deck system **24*b*, when the decks 54, 56 are in the hi-deck arrangement, the spacing between the floor 32 and the lower deck 56 is equal to the spacing between the upper deck 54 (which is sitting directly on top of the lower deck 56) and the panel 40*c* in the top wall 38. When the decks 54, 56 are in the tri-deck arrangement, the spacing between the floor 32 and the lower deck 56, the spacing between the lower deck 56 and the upper deck 54 and the spacing between the upper deck 54 and the panel 40*c* in the top wall 38 are equal. In addition, in the tri-deck arrangement, the above-described spacing is slightly greater than the height of the automobile to be transported in the railcar 20**. While this spacing is preferred, it is to be understood that the spacing can be varied upon varying the length of the link members described herein.

The adjustable support system **58*b* of the deck system 24*b* includes a plurality of counterbalancing structures 64*b* spaced along the length of the decks 54, 56 on each side of the decks 54, 56. For purposes of clarity, only a single counterbalancing structure 64*b*, which is described as mounted on side wall 34, is described with the understanding that the other counterbalancing structures 64*b*, including those mounted on side wall 36**, are identical in construction and function.

The counterbalancing structure **64*b* includes a pair of spaced apart sprockets 80, 82 which are rotatably connected to the side wall 34 of the railcar 20 and are positioned between the decks 54, 56. An endless chain 84 is looped around the sprockets 80, 82. A plate 86 covers the chain 84. A first pivotal link member 88 is provided and has an end 90 rotatably connected to the upper deck 54 and the opposite end 92 fixedly connected to the upper sprocket 80. A second pivotal link member 94 is provided and has one end 96 rotatably connected to the lower deck 56 and the opposite end 98 fixedly connected to the lower sprocket 82. The first and second link members 88, 94 are preferably the same length. A plate 100 covers the entire counterbalancing structure 64*b***.

To move the decks 54, 56 to the bi-deck configuration, as shown in FIG. 15, the lower deck 56 is manually pushed upwardly towards the upper deck 54. Because of the counterbalancing structure **64*b*, movement of the lower deck 56 towards the upper deck 54 causes the upper deck 54 to move towards the lower deck 56. When the lower deck 56 is pushed towards the upper deck 54, as the lower deck 56 moves upwardly, the deck 56 rotates relative to the link members 94 and causes the link member 94 to rotate relative to the side wall 34. Because the link member 94 is fixed relative to the sprocket 82, the link member 94 rotates with the sprocket 82 in the direction of the arrow 102 shown in FIG. 14 as the sprocket 82 rotates relative to the side wall 34. Rotation of sprocket 82 causes the endless chain 84 to move with the sprocket 82 thereby causing sprocket 80 to rotate relative to the side wall 34. Rotation of sprocket 80 causes fixedly connected link member 88 to rotate in the direction of arrow 104 which, in turn, causes the upper deck 54 to move towards the lower deck 56. Endless chain 84 also ensures that the decks 54, 56 move at the same rate. The decks 54, 56 move relative to the side wall 34 until the decks 54, 56 abut against each other as shown in FIG. 15. Alternatively, the upper deck 54 may be manually pushed towards the lower deck 56** to cause the movement.

The decks 54, 56 can be moved to the tri-deck arrangement, as shown in FIG. 13, by manually pulling the lower deck 56 away from the upper deck 54. Again, because of the counterbalancing structure **64*b*, movement of the lower deck 56 away from the upper deck 54 causes the upper deck 54 to move away from the lower deck 56. When the lower deck 56 is pulled away from the upper deck 54, as the lower deck 56 moves downwardly, the deck 56 rotates relative to the link members 94 and causes the link member 94 to rotate relative to the side wall 34. Because the link member 94 is fixed relative to the sprocket 82, the link member 94 rotates with the sprocket 82 in the direction opposite to arrow 102 as the sprocket 82 rotates relative to the side wall 34. Rotation of sprocket 82 causes the endless chain 84 to move with the sprocket 82 thereby causing sprocket 80 to rotate relative to the side wall 34. Rotation of sprocket 80 causes fixedly connected link member 88 to rotate in the direction opposite to arrow 104 which, in turn, causes the upper deck 54 to move away from the lower deck 56. As the decks 54, 56 move, the link members 88, 94 rotate with the respective sprockets 80, 82 and the sprockets 80, 82 rotate relative to the side wall 34. The endless chain 84 moves around the sprockets 80, 82 to ensure that the decks 54, 56 move at the same rate. The decks 54, 56 move relative to the side wall 34 until the decks 54, 56 are moved into the spaced apart relationship shown in FIG. 13. Alternatively, the movement may be effected by manually pushing the upper deck 54 away from the lower deck 56**.

The decks 54, 56 can be manually pushed by hand. Alternatively, other means can be used. For example, a detachable wrench can be used to generate a moment or a chain attached to a worm screw can be used.

Attention is now directed to the third embodiment of the novel deck system 24c as shown in FIGS. 16 and 17. In this embodiment of the deck system 24c, like that of the second embodiment of the deck system 24b, the decks 54, 56 can only be moved between two positions and are counterbalanced against each other. One position, as shown in FIG. 16, provides the tri-deck arrangement. The other position, as shown in FIG. 17, provides the bi-deck arrangement. Once the decks 54, 56 are moved to the desired position relative to each other, the decks 54, 56 cannot be moved relative to the floor 32 of the railcar 20 as can be effected in the first embodiment of the deck system 24.

In this third embodiment of the deck system 24c, like that of the second embodiment of the deck system 24b, when the decks 54, 56 are in the bi-deck arrangement, the spacing between the floor 32 and the lower deck 56 is equal to the spacing between the upper deck 54 (which is sitting directly on top of the lower deck 56) and the panel 40c in the top wall 38. When the decks 54, 56 are in the tri-deck arrangement, the spacing between the floor 32 and the lower deck 56, the spacing between the lower deck 56 and the upper deck 54 and the spacing between the upper deck 54 and the panel 40c in the top wall 38 are equal. In addition, in the tri-deck arrangement, the above-described spacing is slightly greater than the height of the automobile to be transported in the railcar 20. While this spacing is preferred, it is to be understood that the spacing can be varied upon varying the length of the counterbalancing structure 64c described herein.

The adjustable support structure 58c shown in the third embodiment of the novel deck system 24c is schematically illustrated in FIGS. 16 and 17. The decks 54, 56 are connected to each other by a plurality of counterbalancing structures 64c (only two are shown for clarity), each of which includes a flexible, non-extendable connecting element 66c, such as a chain, which are spaced apart from each other along the length of the decks 54, 56 and a rotatable sprocket 68c. The sprocket 68c is fixedly anchored proximate to the upper end of the side wall 36. The chain 66c extends around or is looped around the sprocket 68c. One end of each chain 66c is connected to edge of the upper deck 54; the chain 66c extends around one of the sprockets 68c, and the opposite end of the chain 66c is connected to the edge of the lower deck 56. The ends of each chain 66c are connected to the decks 54, 56 by suitable means. The decks 54, 56 are counterbalanced against each other such that the lower deck 56 only needs to be pushed down manually to cause the upper deck 54 to move upwardly and similarly, the lower deck 56 only needs to be pushed upwardly manually to cause the upper deck 54 to move downwardly.

In addition, the adjustable support structure 58c includes lateral support structures 104 for laterally supporting the decks 54, 56 as they are moved relative to each other. Each lateral support structure 104 includes a plurality of first and second connecting elements 106, 108, only two of each are shown for clarity. Each connecting element 106, 108 includes a flexible, non-extendable member, such as a chain, and sprockets as described herein.

Each of connecting elements 106 have an upper end which is anchored proximate to the upper end of the side wall 34 and a lower end which is anchored proximate to the floor 32 and the opposite side wall 36. It is to be noted that the upper end of connecting element 106 is anchored to the opposite side wall than that which sprocket 68c is anchored. For each connecting element 106, the upper deck 54 has a pair of sprockets 110, 112 mounted thereunder for engagement with the chain 106. The sprockets 110, 112 are mounted proximate to the outer margins of the deck 54. Each chain 106 extends downwardly from its fixed upper end along the side wall 34, under the sprocket 110 mounted under the deck 54 which is proximate to the side wall 34, extends underneath the deck 54 across the width of the deck 54 and over the sprocket 112 which is mounted proximate to the other side wall 36 of the railcar 20 and then downwardly to its fixed lower end.

A coordination shaft or drive shaft 114 is engaged between the sprockets 112. The drive shaft 114 causes the sprockets 112 to rotate at the same speed to deter the deck 54 from tipping by preventing one end of the deck 54 from moving faster than the other end as it is being moved upwardly or downwardly. A like drive shaft may be provided between sprockets 110.

Similarly, each of connecting elements 108 have an upper end which is anchored proximate to the upper end of the side wall 34 and a lower end which is anchored proximate to the floor 32 and the opposite side wall 36. It is to be noted that the upper end of connecting element 108 is anchored to the opposite side wall than that which sprocket 68c is anchored. For each connecting element 108, the lower deck 56 has a pair of sprockets 116, 118 mounted thereunder for engagement with the chain 108. The sprockets 116, 118 are mounted proximate to the outer margins of the deck 56. Each chain 108 extends downwardly from its fixed upper end along the side wall 34, under the sprocket 116 mounted under the deck 56 which is proximate to the side wall 34, extends underneath the deck 56 across the width of the deck 56 and over the sprocket 118 which is mounted proximate to the other side wall 36 of the railcar 20 and then downwardly to its fixed lower end.

A coordination shaft or drive shaft 120 is engaged between the sprockets 118. The drive shaft 120 causes the sprockets 118 to rotate at the same speed to deter the deck 56 from tipping by preventing one end of the deck 56 from moving faster than the other end as it is being moved upwardly or downwardly. A like drive shaft may be provided between sprockets 116.

To move the decks 54, 56 to the bi-deck configuration, as shown in FIG. 17, the lower deck 56 is manually pushed upwardly towards the upper deck 54. Because of the counterbalancing structure 64c, movement of the lower deck 56 towards the upper deck 54 causes the upper deck 54 to move towards the lower deck 56. When the lower deck 56 is pushed towards the upper deck 54, the chains 66c move around sprockets 68c. The length of each chain 66c between the upper deck 54 and the sprocket 68c becomes greater and the length of each chain 66c between the lower deck 56 and the chain 66c shortens as the decks 54, 56 move towards each other.

In addition, as the decks 54, 56 move relative to each other, the decks 54, 56 move relative to the lateral support structures 104. The upper deck 54 moves along the length of the chains 106 by action of the sprockets 110, 112 moving relative to the chain 106. The lower deck 56 moves along the length of the chains 108 by action of the sprockets 116, 118 moving relative to the chain 108.

To move the decks 54, 56 to the tri-deck configuration, as shown in FIG. 16, the lower deck 56 is manually pulled downwardly away from the upper deck 54. Because of the counterbalancing structure 64c, movement of the lower deck 56 away from the upper deck 54 causes the upper deck 54 to move away from the lower deck 56. When the lower deck 56 is pulled away from the upper deck 54, the chains 66c move around sprockets 68c. The length of each chain 66c between the upper deck 54 and the sprocket 68*c* shortens and the length of each chain 66*c* between the lower deck 56 and the chain 66*c* lengthens as the decks 54, 56 move away from each other.

In addition, as the decks 54, 56 move relative to each other, the decks 54, 56 move relative to the lateral support structures 104. The upper deck 54 moves along the length of the chains 106 by action of the sprockets 110, 112 moving relative to the chain 106. The lower deck 56 moves along the length of the chains 108 by action of the sprockets 116, 118 moving relative to the chain 108.

Attention is now directed to the fourth and final embodiment of the novel deck system 24*d*. In this embodiment of the deck system 24*d*, like that of the previous embodiments of the deck system, the decks 54, 56 can be moved between two positions and are counterbalanced against each other. In addition, however, like the first embodiment of the deck system 24, the decks 54, 56 can be moved relative to the floor 32 of the railcar 20 once the decks 54, 56 are positioned in the desired position. A tri-deck arrangement is shown in FIG. 18. A bi-deck arrangement is illustrated in FIG. 19. FIG. 20 shows how the decks 54, 56, once moved to the desired relative position, can be moved to rest on the floor 32 of the railcar 20.

In this fourth embodiment of the deck system 24*d*, like that of the second and third embodiments of the deck system 24*b*, 24*c*, when the decks 54, 56 are in the bi-deck arrangement, the spacing between the floor 32 and the lower deck 56 is equal to the spacing between the upper deck 54 (which is sitting directly on top of the lower deck 56) and the panel 40*c* in the top wall 38. When the decks 54, 56 are in the tri-deck arrangement, the spacing between the floor 32 and the lower deck 56, the spacing between the lower deck 56 and the upper deck 54 and the spacing between the upper deck 54 and the panel 40*c* in the top wall 38 are equal. In addition, in the tri-deck arrangement, the above-described spacing is slightly greater than the height of the automobile to be transported in the railcar 20. While this spacing is preferred, it is to be understood that the spacing can be varied upon varying the length of the counterbalancing structure 64*d* described herein.

The adjustable support structure 58*d* shown in the fourth embodiment of the novel deck system 24*d* is schematically illustrated in FIGS. 18–20. The adjustable support structure 58*d* includes lateral support structures 104*d* for laterally supporting the decks 54, 56 as they are moved relative to each other. The lateral support structures 104*d* are identical in construction as the lateral support structures 104 in the third embodiment. As such, a repetition of the construction and how the lateral support structures 104*d* function when the decks 54, 56 are being moved is not repeated herein.

The adjustable support structure 58*d* includes counterbalancing structure 64*d* which connects the decks 54, 56 to each other. The decks 54, 56 are counterbalanced against each other such that the lower deck 56 only needs to be pushed down manually to cause the upper deck 54 to move upwardly and similarly, the lower deck 56 only needs to be pushed upwardly manually to cause the upper deck 54 to move downwardly. The counterbalancing structure 64*d* includes first and second flexible, non-extendable connecting elements 122, 124, each of which is a chain. In addition, the counterbalancing structure 64*d* is used to raise and lower the decks 54, 56 relative to the floor 32 once the decks 54, 56 are moved to the desired position relative to each other.

The first chain 122 has a first end 126 which is fixedly connected to the lower deck 56 and a second end 128 which is fixedly connected to the upper deck 54. The chain 122 extends upwardly from its fixed, first end 126 to a first sprocket 130 that is anchored proximate to the upper end of the side wall 36 of the railcar 20. The chain 122 is looped over the sprocket 130 and extends over to a second sprocket 132 that is anchored proximate to the upper end of the side wall 36 but is spaced from the first sprocket 130. The chain 122 is looped over the second sprocket 132 and extends downwardly to a first main sprocket 134. The chain 122 is looped around the first main sprocket 134 and then extends upwardly therefrom to a third sprocket 136 that is anchored proximate to the upper end of the side wall 36 of the railcar 20. The chain 122 is looped over the third sprocket 136 and extends over to a fourth sprocket 138 that is anchored proximate to the upper end of the side wall 36 but is spaced from the third sprocket 138. The chain 122 is looped over the fourth sprocket 138 and extends downwardly to the upper deck 34 where the second end 128 of the chain 122 is fixedly connected. The sprockets 130, 132, 136, 138 are anchored proximate to the opposite side wall 36 of the railcar 20 than that which the upper end of the lateral support structures 104*d* are anchored. The chain 122 is connected to the decks 54, 56 by suitable means.

The second chain 124 has a first end 140 which is fixedly connected to the upper deck 54 and a second end 142 which is fixedly connected to the lower deck 56. The chain 124 extends upwardly from its fixed, first end 140 to a first sprocket 144 that is anchored proximate to the upper end of the side wall 36 of the railcar 20. The chain 124 is looped over the sprocket 144 and extends over to a second sprocket 146 that is anchored proximate to the upper end of the side wall 36 but is spaced from the first sprocket 144. The chain 124 is looped over the second sprocket 146 and extends downwardly to a second main sprocket 148. The chain 124 is looped around the second main sprocket 148 and then extends upwardly therefrom to a third sprocket 150 that is anchored proximate to the upper end of the side wall 36 of the railcar 20. The chain 124 is looped over the third sprocket 150 and extends over to a fourth sprocket 152 that is anchored proximate to the upper end of the side wall 36 but is spaced from the third sprocket 150. The chain 124 is looped over the fourth sprocket 152 and extends downwardly to the lower deck 36 where the second end 142 of the chain 124 is fixedly connected. The sprockets 144, 146, 150, 152 are anchored proximate to the opposite side wall 36 of the railcar 20 than that which the upper end of the lateral support structures 104*d* are anchored. The chain 124 is connected to the decks 54, 56 by suitable means.

The first and second main sprockets 134, 148 are connected together by a shaft 154 so that the sprockets 134, 148 rotate at the same rate. The main sprockets 134, 148 are housed in a casing 156 and are rotatable relative thereto. The casing 156 is connected to a driving means 158, such as a winch, by a flexible, non-extendable connecting element 160, such as a chain. The driving means 158 is mounted in the floor 32 of the railcar 20. The driving means 158 is used to move the first and second main sprockets 134, 148 upwardly and downwardly relative to the floor 32 of the railcar 20 so that the decks 50, 54, once moved to the desired position relative to each other, can be moved relative to the floor 32 as described herein.

To move the decks to the bi-level configuration as shown in FIG. 19, the lower deck 56 is pushed towards the upper deck 54. The decks 54, 56 move relative to the lateral support structures 104 as described hereinabove with respect to the third embodiment of the deck system 24*c* and the description is not repeated herein. With respect to the counterbalancing structure 64d, as the lower deck 56 moves towards the upper deck 54, the chain 122 moves relative to the sprockets 130, 132, 134, 136, 138. The length of the chain 122 between the lower deck 56 and the sprocket 130 lessens and the length of the chain 122 between the upper deck 54 and the sprocket 138 lengthens. In addition, the chain 124 moves relative to the sprockets 144, 146, 148, 150, 152. The length of the chain 124 between the upper deck 56 and the sprocket 144 lengthens and the length of the chain 124 between the lower deck 56 and the sprocket 152 becomes shorter.

To move the decks to the tri-level configuration as shown in FIG. 18, the lower deck 56 is pushed away from the upper deck 54. The decks 54, 56 move relative to the lateral support structures 104 as described hereinabove with respect to the third embodiment of the deck system 24c and the description is not repeated herein. With respect to the counterbalancing structure 64d, as the lower deck 56 moves away from the upper deck 54, the chain 122 moves relative to the sprockets 130, 132, 136, 138. The length of the chain 122 between the lower deck 56 and the sprocket 130 becomes greater and the length of the chain 122 between the upper deck 54 and the sprocket 138 becomes shorter. In addition, the chain 124 moves relative to the sprockets 144, 146, 150, 152. The length of the chain 124 between the upper deck 56 and the sprocket 144 shortens and the length of the chain 124 between the lower deck 56 and the sprocket 152 lengthens.

Thereafter, the decks 54, 56 can be moved relative to the floor 32 of the railcar 20 by the driving means 158 and the chain 160. The chain 160 is wound around a drum in the driving means 158. To move the decks 54, 56 relative to the floor 32, the driving means 158 unwinds the chain 160 from around the drum to move the main sprockets 134, 148 upwardly towards the top of the railcar 20. As the main sprockets 134, 148 move upwardly, the length of the chains 122, 124 between the main sprockets 134, 148 and the respective sprockets 132, 136; 146, 150 shortens which lengthens the length of the chains 122, 124 between the sprockets 144, 130; 138, 152 and the decks 54, 56 thereby lowering the decks 54, 56 towards the floor 32. The decks 54, 56 can be lowered so that they rest on the floor 32, as shown in FIG. 20, to provide a completely unobstructed space within the railcar 20 so that general freight can be easily loaded into the railcar 20 as described herein. Depending on the initial position of the main sprockets 134, 148 and the length of the chain 160, the decks 54, 56 can be moved so as to be proximate to the upper ends of the side walls 34, 36 of the railcar 20.

It is to be understood that the above-described embodiments of the adjustable support structure 58 can take a variety of forms of which one of ordinary skill in the art could devise. For example, a motor-driven drive shaft which is engaged with a bevelled gear that is connected to a spur gear or screw jack could be used to move the decks. In addition, the decks 54, 56 could be attached to rollers which roll along tracks formed in the side walls 34, 36 of the railcar 20.

In any of the above-described embodiments of the novel deck system, the decks 54, 56 are approximately the same size as, but just slightly smaller than, the interior dimensions of the railcar 20. Thus, when the decks 54, 56 are being moved relative to the side walls 34, 35 of the railcar 20, the decks 54, 56 are prevented from swinging in the railcar 20 by the side posts and the front and rear walls of the railcar 20 when the decks 54, 56 are being raised or lowered. If desired, however, a suitable mechanism may be provided for preventing the decks 54, 56 from swinging relative to the side walls 34, 36 of the railcar 20. In addition, in any of the above-described embodiments of the deck system, it is envisioned that pulleys could be substituted for the sprockets and cables could be substituted for the chains.

Furthermore, in any of the above-described embodiments of the novel deck system, after the decks 54, 56 have been moved to the desired position, the decks 54, 56 can be secured to or attached to the side walls 34, 36 of the railcar 20 by a bracket which is releasably attached to an opening in the side wall 34 in order to prevent the decks 54, 56 from moving within the railcar 20. Such brackets are disclosed in co-pending U.S. patent application Ser. No. 08/389,205, filed Feb. 15, 1995, entitled "Auto Hauling Van" which is commonly owned by the assignee herein, and which disclosure is herein incorporated by reference. Alternatively, a dead bolt pin may be provided on each of the decks 54, 56 which selectively enters into an aperture provided on the side wall 34, 36 of the railcar 20. If the deck or decks 54, 56 are resting against the floor 32, such a bracket does not need to be used since the decks 54, 56 cannot move relative to the floor 32.

Attention is now directed to the specifics of the novel low-level, low-profile, no slack coupler 22 which is best illustrated in FIGS. 6 and 12. The coupler 22 is used to attach each railcar 20 to adjacent railcars within the unit 26. The no slack coupler 22 is formed from a front tongue 162 which is attached to a front end of the railcar 20 and a socket 164 within the rear end of the railcar 20. The front tongue 162 has an aperture 163 therethrough. To connect the railcars 20 together, each tongue 162 is inserted into a corresponding socket 164 in the adjacent railcar 20. A retractable pin 166 within the socket 164 extends through the aperture 163 in the tongue 162 to securely hold the tongue 162 within the socket 164. To release the tongue 162 from the socket 164, the pin 166 is retracted out of engagement with the aperture 163 in the tongue 162 and the tongue 162 is withdrawn from the socket 164. Such a retractable pin structure 166 is disclosed in United Kingdom Patent No. 2,168,020 whose disclosure is incorporated herein by reference.

The socket 164 is formed in a casting 168, as shown in FIG. 6, that protrudes upwardly from the floor 32 to a height which is less than the distance to the underside of the automobiles which is to be loaded into the railcar 20. In addition, the casting 168 protrudes upwardly from the floor 32 to a height which is less than the distance to the underside of the forklift which is carrying the general freight onto the railcar 20. The casting 168 extends into the interior of the railcar 20 a short distance, is positioned along generally a centerline of each of the railcars 20 and is spaced from the side walls 34, 36 of the railcars 20 a predetermined distance such that a level floor surface 170 is provided on each side of the casting 168. Alternatively, the rear socket 164 does not extend upwardly from a casting and instead, the floor 32 of the railcar 20 is completely flat. It is envisioned that the front tongue 162 may also extend outwardly from a like casting.

As shown in FIG. 1, the end railcars, shown as 20a, 20b, of the unit 26 have means for connecting the end railcars 20a, 20b to other railcars in the articulated train. The front end 28 of the forwardmost railcar 20a in the unit 26 is attached to a railroad bogie 172 by engaging the front tongue 162 on the railcar 20a within a socket in a casting 174 on the bogie 172 and releasably securing the tongue 162 therein by suitable means. The front tongue 162 may be releasably secured within the socket in the casting 174 on the bogie 172 by engaging a retractable pin within the socket through the aperture 163 in the tongue 162 in accordance with the retractable pin structure disclosed in United Kingdom Patent No. 2,168,020.

A knuckle coupler plug 176 is attached within a socket in the casting 174 and can be detached therefrom. The plug 176 extends forwardly from the bogie 172. The plug 176 may be held within the socket in the casting 174 by a retractable pin which extends through an aperture in the rear end of the plug 176 in a similar manner as to how the front tongue 162 is held within the casting 174.

The rearmost railcar **20*b* in the unit 26 has a knuckle coupler plug 178 attached within the rear socket 164, which knuckle coupler plug 178 can be detached therefrom. The knuckle coupler plug 178 may be releasably held within the socket 164 by a retractable pin which extends through an aperture in the forward end of the plug 178**.

To attach the unit 26 to the remainder of the articulated train, the knuckle coupler plug 176 attached to the bogie 172 is engaged within a socket 164 in the railcar 20 thereahead. The knuckle coupler plug 178 attached to the socket 164 in the rearmost railcar **20*b*** is attached to a socket within a casting on a railroad bogie which is connected to the railcar therebehind.

When the railcars 20 are connected together to form the unit 26, the forwardmost railcar **20*a*, when attached to the remainder of the train, is supported by the bogie 52 at its rear end and by the bogie 172 at its front end. The railcars 20 in the center of the unit 26 are supported by the bogie 52 at its rear end and by the front tongue 162 engagement within the socket 164 in the rear end of the railcar 20 thereahead. The rearmost railcar 20*b* in the unit 26 is supported by the front tongue 162 engagement within the socket 164 in the rear end of the railcar 20 thereahead and by the bogie 52 at its rear end. In addition, the rearmost railcar 20*b* in the unit 26 is supported at its rear end by a bogie (not shown but similar to bogie 172) with which the plug 178** is engaged.

When automobiles 171, small trucks, a fork-lift carrying general freight or the like are being loaded onto the train, the automobiles 171 or the like are driven from the back end of the train, through each of the railcars 20 to the front of the train to fill the train. The automobiles 171, small trucks, a fork-lift carrying general freight or the like can be driven through the entire train from deck to deck or from floor to floor because the adjustable support system **58–58*d* does not encumber the interior space of the railcar 20 in which the automobile 171 or the like occupies within the railcar 20. In addition, when the embodiments of the deck system that allow the decks 54, 56 to be positioned on the floor 32 of the railcar 20 are provided and the decks 54, 56 are positioned on the floor, general freight can be easily loaded onto the upper deck 54 because the interior space within the railcar 20** is generally unobstructed by the deck system.

As the automobile 171 is driven from one railcar 20 to the next across the deck plates 62, the tires 173 of the automobile 171 straddle the novel low-level, low-profile coupler 22 as shown in FIGS. 6 and 12. The deck plates 62 are level with the surface 170 of the floor 32 alongside the casting 168. Thus, a level surface is provided between the railcars 20 for the easy loading and unloading of the automobiles 171, small trucks, a fork-lift carrying general freight or the like.

In addition, this allows the decks 54, 56 above the automobile 171 to be extremely close to the roof of the automobile 171 since the automobile 171 is not driven over the coupler 22. Thus, the cargo space within the railcar 20 is maximized. Moreover, since the automobile 171 is not driven over the novel low-level, low-profile coupler 22, the roof of the automobile 171 will not be damaged on the deck 54, 56 thereabove as it passes between adjacent railcars 20. While the automobile 171 is shown as be loaded in an offset manner relative to the center of the railcar 20, it is to be understood that the automobiles or the like can be centered relative to the railcar 20.

To remove an individual railcar 20 from the remainder of articulated train, so that it can be loaded or unloaded, the railcar 20 is moved onto a portion of the railroad track that is level with the ground or is surrounded by gravel so that the portion is level with the ground. The landing gear 44 on the railcar 20 is extended so that the railworthy wheels 46 come into contact with the railroad rails **50*a*, 50*b***.

Thereafter, if the forwardmost railcar **20*a* is to be released, the front tongue 162 is released from its engagement with the bogie 172 and the front tongue 162 on the railcar 20 therebehind is released from its engagement within the rear socket 164. If the rearmost railcar 20*b* is to be released, the front tongue 164 on the railcar 20 is released from its engagement within the socket 164 on the railcar 20 thereahead and the knuckle coupler plug 178 is released from its engagement with the railcar 20 therebehind. Thereafter, the knuckle coupler plug 178 is removed from its engagement with the rear socket 164. If a middle railcar 20 is to be released, the no slack couplers 22 are released forward and rearward of the railcar 20. That is, the front tongue 162 is released from its engagement with the socket 164 railcar 20 thereahead and the tongue 162 on the railcar 20 therebehind is released from within the rear socket 164**.

Thus, the released railcar 20 is supported on the rails **50*a*, 50*b* by the bogie 52 and the landing gear 44. Because the landing gear 44 has railworthy, flanged wheels 46*a*, 46*b* thereon and the bogie 52 is bi-directional, the released railcar 20 can be moved forward or backward on the rails 50*a*, 50*b***.

Subsequently, the railcars which are forward and rearward of the released railcar 20 are moved relative to the released railcar 20 so as to isolate the released railcar 20 on the tracks. A prime mover 180, such as a tractor, is backed up to the front end 28 of the released railcar 20 and is connected thereto. The tractor 180 may be connected to the railcar 20 by engaging the front tongue 162 in a socket in a casting 182 on the tractor 180. The tongue 162 is held in the socket in the casting 182 by a suitable retractable pin which extends through the aperture 163 in the tongue 162. Other suitable structures can be provided for coupling the tractor 180 and the front end of the railcar 20 together.

Figure 4:
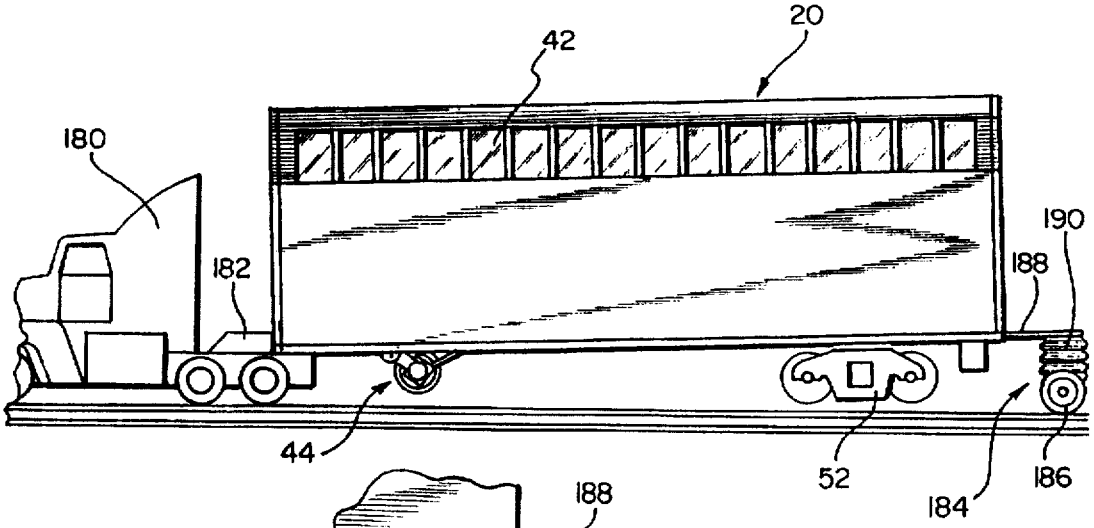
FIG. 4 is a side elevational view of the railcar shown in FIG. 3 with the dolly adaptor expanded so as to raise the back end of the railcar off of the ground such that the bogie attached thereto is no longer in contact with the railroad tracks so that the railcar can be moved off of the railroad tracks and transported around a rail yard.
Figure 4A:
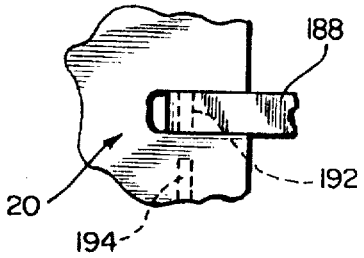
FIG. 4A is a partial, schematic view of a mechanism for attaching the dolly adaptor within a socket in the railcar.

Next, a dolly adaptor 184 is attached to the rear end 30 of the railcar 20, as described hereinbelow, and the landing gear 44 is retracted. The dolly adaptor 184 has a pair of wheels 186 and a platform 188 which has an expandable air bag 190 therebetween. The wheels 186 are suitable for moving the dolly adaptor 184 around a rail yard. The platform 188 has structure thereon which can be attached into the rear socket 164, or to a knuckle coupler plug, identical to plug 178, to connect the dolly adaptor 184 and the rear end 30 of the rearmost railcar 20 together. For example, the platform 188 can have an aperture 192 therethrough, which can be attached into the socket 164, by the retractable pin 194 in the socket 164 extending through the aperture 192 in the platform 188 as shown in FIG. 4A. Alternatively, the platform 188 can have a casting thereon which has a socket therein in which the knuckle coupler plug 178 is securely engaged but detachable therefrom. Other suitable structures can be provided for coupling the dolly adaptor 184 and the rear end of the railcar 20 together.

The air bag 190 can be expanded or inflated by a suitable air source to raise the back end of the railcar 20 until the rail bogie 52 mounted beneath the rear end of the railcar 20 does not contact the rails 50*a*, 50*b*. Alternatively, the bogie 52 can have structure thereon which allows the bogie 52 to be released from the railcar 20. If this configuration is provided, the air bag 190 is inflated until the rear end of the railcar 20 is lifted off of the bogie 52. It is to be understood that dolly adaptors having different structure and different means for lifting the rear end of the railcar 20 than that shown and described herein, which one of ordinary skill in the art could devise, are within the scope of the invention.

Figure 5:
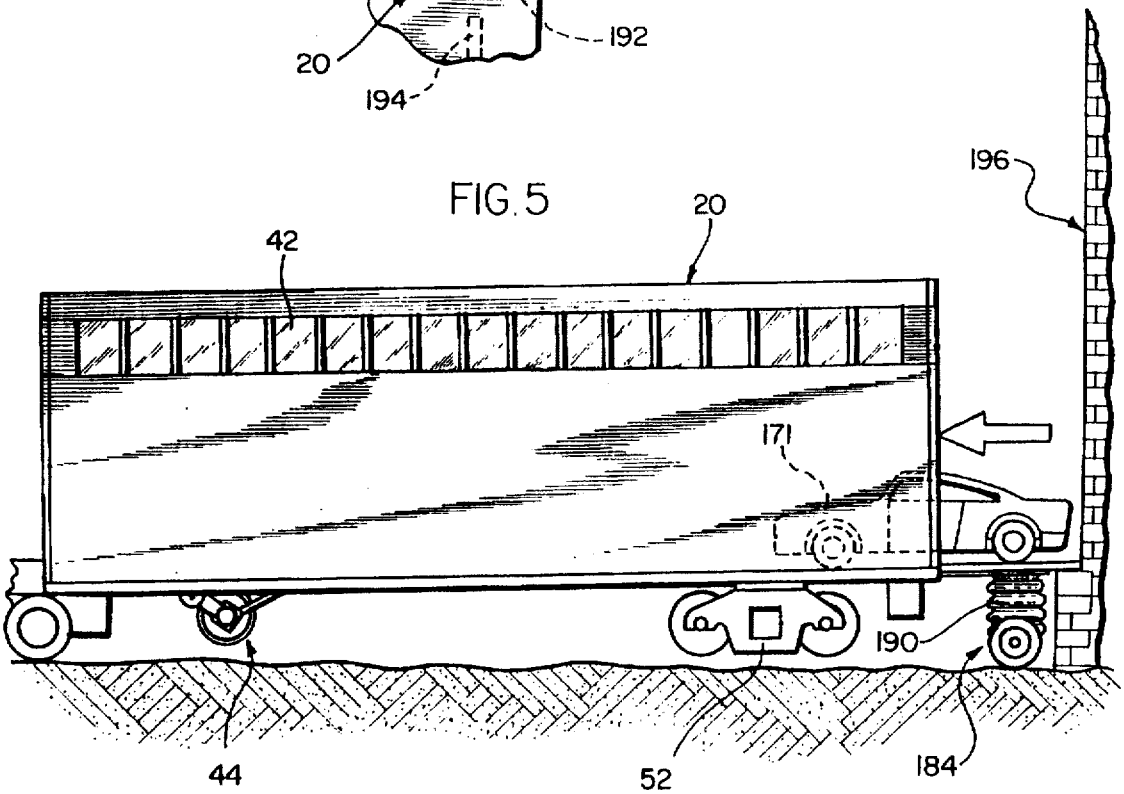
FIG. 5 is a side elevational view of the railcar shown in FIG. 3 showing how an automobile is loaded onto the floor of the railcar from a dock.

The lifted railcar 20 can be moved off of the rails 50*a*, 50*b* via the tractor 180 and the dolly adaptor 184. Thereafter, the lifted railcar 20 can be driven or transported around the rail yard, so that the railcar 20 can be backed up to a dock 196 and loaded as shown in FIG. 5.

The dock 196 from which the railcar 20 is loaded may be a single-level, a bi-level or a tri-level loading dock depending on the positioning of the decks 54, 56 within the railcar 20. If the decks 54, 56 are in a tri-level configuration, automobiles, small trucks, a fork-lift carrying general freight or the like can be loaded onto the upper deck 54, the lower deck 56 and the floor 32 from a tri-level dock at the same time. Similarly, if the decks 54, 56 are in a bi-level configuration, automobiles, small trucks, a fork-lift carrying general freight or the like can be loaded onto the upper deck 54 and the lower deck 56 or floor 32 from a bi-level dock at the same time. This allows the railcar 20 to be quickly and easily loaded from a dock.

After the railcar 20 has been loaded, the railcar 20 is transported back to the railroad tracks by the tractor 180 and the dolly adaptor 184 to the proper position in the train. The air bag 190 on the dolly adaptor 184 is deflated so that the bogie 52 is brought back into contact with the rails 50*a*, 50*b*. The landing gear 44 is once again extended until the flanged wheels 46*a*, 46*b* come into contact with the rails 50*a*, 50*b*. Thereafter, the dolly adaptor 184 is disconnected from the railcar 20. The tractor 180 is used to back the disconnected railcar 20 up to the railcars in the train therebehind and the railcar 20 is re-coupled therewith. Alternatively, the remaining railcars may be moved towards the detached railcar 20 by suitable means. Thereafter, the tractor 180 is disconnected from the railcar 20. The railcars in the train forward of the previously detached railcar 20 are backed up on the rails 50*a*, 50*b* or the railcars which include the previously detached railcar 20 are moved forward until the last railcar in the train is suitably reconnected with the previously disconnected railcar 20. Other suitable procedures for moving the previously detached railcar and the remainder of the train relative to each other are within the scope of the invention.

Thereafter, the landing gear 44 is retracted upwardly so that the wheels 46*a*, 46*b* do not contact the rails 50*a*, 50*b*. During transport over rail, the landing gear 44 is always retracted such that it does not contact the rails.

As a result, a single railcar 20 can be easily removed from the remainder of the articulated train without the need for a switching yard. It is also envisioned that more than a single railcar can be released from the train and moved around the rail yard to be loaded.

While embodiments of the present invention are shown and described, it is envisioned that those skilled in the art may devise various modifications of the present invention without departing from the spirit and scope of the appended claims.

The invention claimed is:

1. A railcar comprising: a floor and upstanding side walls connected to said floor; a deck system housed between said side walls, said deck system comprising an upper deck and a lower deck, an adjustable support structure for supporting said upper deck and lower deck over said floor, said upper and lower decks being movable to a first position wherein said upper and lower decks abut against each other such that cargo can be loaded onto said upper deck and onto said floor, said upper and lower decks being movable to a second position wherein said upper and lower decks are spaced apart from each other such that cargo can be loaded onto said upper deck, said lower deck and said floor, said upper and lower decks being connected together by said adjustable support structure such that when one of said decks moves, the other of said decks moves.

2. A railcar as defined in claim 1, wherein said adjustable support structure comprises structure for counterbalancing said upper and lower decks against each other such that when said upper deck moves in an upward direction, said lower deck moves in a downward direction and when said upper deck moves in an downward direction, lower deck moves in an upward direction.

3. A railcar as defined in claim 2, wherein said counterbalancing structure comprises flexible elements which are connected to said upper and lower decks, each said flexible element further being connected proximate to one of said side walls.

4. A railcar as defined in claim 2, wherein said adjustable support structure further comprises lateral support structures for laterally supporting said decks to deter said decks from tipping when said decks are being moved to said first or second position.

5. A railcar as defined in claim 4, wherein said lateral support structure comprise flexible elements, at least one said flexible element having an upper end anchored proximate to an upper end of one said side wall and a lower end anchored proximate to said floor and proximate to an opposite side wall and being connected to said upper deck by connecting structure such that said flexible element, and at least one said flexible element having an upper end anchored proximate to an upper end of one said side wall and a lower end anchored proximate to said floor and proximate to an opposite side wall and being connected to said lower deck by connecting structure such that said lower deck can move upwardly or downwardly along said flexible element.

6. A railcar as defined in claim 5, wherein said flexible elements comprise chains or the like and said connecting structure for connecting said chains or the like to said respective decks comprises sprockets or the like.

7. A railcar as defined in claim 1, further including structure for moving said upper and lower decks relative to said floor when said decks are in said first position or in said second position.

8. A railcar as defined in claim 7, wherein said structure for moving said upper and lower decks relative to said floor comprises a driving means and a driving element attached to said driving means, said driving element being flexible and further being connected to said flexible element, said driving means selectively allowing said driving element to lengthen or shorten to lower or raise said decks when said decks are in said first or second positions.

9. A railcar as defined in claim 7, wherein said decks when in said first position can be moved so as to rest on said floor by action of said structure for moving said upper and lower decks relative to said floor.

10. A railcar as defined in claim 1, wherein said adjustable support structure comprises a first pivotal link member connected to said lower deck and a second pivotal link member connected to said upper deck, structure for connecting said link members together such that rotation of said first link member to move said lower deck towards said upper deck causes rotation of said second link member to move said upper deck towards said lower deck.

11. A railcar as defined in claim 10, wherein said structure for connecting said link members together comprises a first sprocket anchored proximate to said side wall and connected to first link member and a second sprocket anchored proximate to said side wall and connected to said second link member, and an endless chain member connected between said sprockets, wherein rotation of said lower sprocket which is caused by movement of said lower towards said upper deck causes said endless chain member to move around said sprockets to cause rotation of said upper sprocket thereby causing said upper deck to move towards said lower deck.

12. A railcar as defined in claim 1, further including a no-slack coupling structure for coupling said railcar with other railcar.

13. A railcar as defined in claim 12, wherein said no-slack coupling structure comprising a tongue attached to an end of said railcar and a socket formed at the opposite end of said railcar, said tongue being releasably attached within a socket in one of said other railcar to connect said railcar together, said socket on said railcar releasably holding a tongue therein on another one of said other railcars to connect said railcars together.

14. A railcar as defined in claim 13, further including a casting which extends above the level of the floor and in which said socket is formed, said casting being positioned along generally a centerline of said railcar and spaced from said side walls of said railcar.

15. A railcar as defined in claim 1, further including a top wall connected to the upper ends of said side walls to form an enclosure, said enclosure defining an interior space in which said decks are housed, said side walls being formed from an opaque material, said top wall having light-transmitting windows therein to allow light to enter into the interior space of said enclosure.

16. A railcar as defined in claim 15, further including a plurality of light-transmitting windows in said upper deck and said lower deck, said windows in said decks allowing light which enters into the interior space of the enclosure through the windows in the top wall to pass through said decks to illuminate the interior space within the enclosure beneath the decks.

17. A railcar comprising: a floor and upstanding side walls connected to said floor; a deck system housed between said side walls, said deck system comprising an upper deck and a lower deck, an adjustable support structure for supporting said upper deck and lower deck over said floor, said upper and lower decks being movable to a first position wherein said upper and lower decks abut against each other such that cargo can be loaded onto said upper deck and onto said floor, said upper and lower decks being movable to a second position wherein said upper and lower decks are spaced apart from each other such that cargo can be loaded onto said upper deck, said lower deck and said floor, said upper and lower decks are connected together by said adjustable support structure such that movement of said upper deck causes movement of said lower deck.

18. A railcar as defined in claim 17, further including structure for moving said upper and lower decks relative to said floor of said railcar when said decks are in said first position or in said second position.

19. A train comprising:

a plurality of railcars connected together each said railcar including a floor and upstanding side walls connected to said floor, a deck housed between said side walls, said deck system comprising an upper deck and a lower deck, an adjustable support structure for supporting said upper deck and lower deck over said floor, said upper and lower decks being movable to a first position wherein said upper and lower decks abut against each other such that cargo can be loaded onto said upper deck and onto said floor, said upper and lower decks being movable to a second position wherein said upper and lower decks are spaced apart from each other such that cargo can be loaded onto said upper deck, said lower deck and said floor, said upper and lower decks being connected together by said adjustable support structure such that when one of said decks moves, the other of said decks moves, each said railcar including a no-slack structure for coupling said railcar with said other railcars in said train.

20. A train as defined in claim 19, wherein said adjustable support structure in each said railcar comprises structure for counterbalancing said upper and lower decks against each other such that when said upper deck moves in an upward direction, said lower deck moves in a downward direction and when said upper deck moves in an downward direction, said lower deck moves in an upward direction.

21. A train as defined in claim 20, wherein said counterbalancing structure in each said railcar comprises flexible elements which are connected to said upper and lower decks.

22. A train as defined in claim 20, wherein said adjustable support structure in each said railcar further comprises lateral support structure for laterally supporting said decks to deter said decks from tipping when said decks are being moved to said first or second position.

23. A train as defined in claim 22, wherein said lateral support structure in each said railcar comprise flexible elements, at least one said flexible element having an upper end anchored proximate to an upper end of one said side wall and a lower end anchored proximate to said floor and proximate to an opposite side wall and being connected to said upper deck by connecting structure such that said upper deck can move upwardly or downwardly along said flexible element and at least one said flexible element having an upper end anchored proximate to an upper end of one side wall and a lower and anchored proximate to said floor and proximate to an opposite side wall and being connected to said lower deck by connecting structure such that said lower deck can move upwardly or downwardly along said flexible element.

24. A train as defined in claim 23, wherein said flexible elements comprise chains or the like and said connecting structure for connecting said chains or the like to said respective decks comprises sprockets or the like.

25. A train as defined in claim 19, further including structure for moving said upper and lower decks relative to said floor in each said railcar when said decks are in said first position or in said second position.

26. A train as defined in claim 25, wherein said structure for moving said upper and lower decks relative to said floor comprises a driving means and a driving element attached to said driving means, said driving element being flexible and further being connected to said flexible element, said driving means selectively allowing said driving element to lengthen or shorten to lower or raise said decks when said decks are in said first or said second position.

27. A train as defined in claim 25, wherein said decks when in said first position can be moved so as to rest on said floor.

28. A train as defined claim 19, wherein each said no-slack coupling structure comprises a tongue attached to an end of each said railcar and a socket formed at an opposite end of each said railcar, each said tongue being releasably attached within a socket in another one of said other railcars to connect said railcars together, said socket on each said railcar releasably holding a tongue therein on another one of said other railcars to connect said railcars together.

29. A train as defined in claim 28, further including a casting which extends above the level of the floor and in which said socket is formed, said casting being positioned along generally a centerline of said railcar and spaced from said side walls of said railcar.

30. A train as defined in claim 28, wherein said railcars which are connected together by said no-slack coupling structures form a unit, said unit includes a forwardmost railcar and a rearwardmost railcar, said rearwardmost railcar having a knuckle coupler plug attached to a rear end thereof for connecting the rear end of said unit to other railcars.

31. A train as defined in claim 30, wherein a front end of said forwardmost railcar in said unit is attached to a bogie, said bogie having a knuckle coupler attached thereto for connecting the front end of said unit to other railcars.

32. A train as defined in claim 19, further including a top wall connected to the upper ends of said side walls to form an enclosure, said enclosure defining an interior space in which said decks are housed, said side walls being formed from an opaque material, said top wall having light-transmitting windows therein to allow light to enter into the interior space of said enclosure.

33. A train as defined in claim 32, further including a plurality of light-transmitting windows in said upper deck and said which enters into the interior space of the enclosure through the windows in the top wall to pass through said decks to illuminate the interior space within the enclosure beneath the decks.

34. A train as defined in claim 19, wherein said adjustable support structure in each said railcar comprises a first pivotal link member connected to said lower deck and a second pivotal link member connected to said upper deck, structure for connecting said link members together such that rotation of said first link member to move said lower deck towards said upper deck causes rotation of said second link member to move said upper deck toward said lower deck.

35. A train as defined in claim 34, wherein said structure for connecting said link members together comprises a first sprocket anchored proximate to one of and a second sprocket anchored proximate to one of said side walls connected to said second link member, and an endless chain member connected between said sprockets, wherein rotation of said lower sprocket which is caused by movement of said lower deck towards said upper deck causes said endless chain member to move around said sprocket to cause rotation of said upper sprocket thereby causing said upper deck to move towards said lower deck.

36. A train comprising:

a plurality of railcars connected together, each said railcar including a floor and upstanding side walls connected to said floor, a deck system housed between said side walls, said deck system comprising an upper deck and a lower deck, an adjustable support structure for supporting said upper deck and lower deck over said floor, said upper and lower decks being movable to a first position wherein said upper and lower decks abut against each other such that cargo can be loaded onto said upper deck and onto said floor, said upper and lower decks being movable to a second position wherein said upper and lower decks are spaced apart from each other such that cargo can be loaded onto said upper deck, said lower deck and said floor, each said railcar including a no-slack coupling structure for coupling said railcar with said other railcars in train, said upper and lower decks in each said railcar are connected together by said adjustable support structure such that movement of said upper deck causes movement of said lower deck.

37. A railcar comprising: a floor and upstanding side walls connected to said floor; a deck system housed between said side walls, said deck system comprising an upper deck and a lower deck, an adjustable support structure for supporting said upper deck and lower deck over said floor, said upper and lower decks being movable to a first position wherein said upper and lower decks abut against each other such that cargo can be loaded onto said upper deck and onto said floor, said upper and lower decks being movable to a second position wherein said upper and lower decks are spaced apart from each other such that cargo can be loaded onto said upper deck, said lower deck and said floor, said upper and lower decks are connected together by said adjustable support structure such that movement of said lower deck causes movement of said upper deck.

38. A train comprising:

a plurality of railcars connected together, each said railcar including a floor and upstanding side walls connected to said floor, a deck system housed between said side walls, said deck system comprising an upper deck and a lower deck, an adjustable support structure for supporting said upper deck and lower deck over said floor, said upper and lower decks being movable to a first position wherein said upper and lower decks abut against each other such that cargo can be loaded onto said upper deck and onto said floor, said upper and lower decks being movable to a second position wherein said upper and lower decks are spaced apart from each other such that cargo can be loaded onto said upper deck, said lower deck and said floor, each said railcar including a no-slack coupling structure for coupling said railcar with said other railcars in train, said upper and lower decks in each said railcar are connected together by said adjustable support structure such that movement of said lower deck causes movement of said upper deck.

* * * * *

UNITED STATES PATENT AND TRADEMARK OFFICE

CERTIFICATE OF CORRECTION

PATENT NO. : 5,685,228

DATED : November 11, 1997

INVENTOR(S) : Donald J. Ehrlich, Rodney P. Ehrlich, Francis S. Smidler and DeWayne B. Williams It is certified that error appears in the above-indentified patent and that said Letters Patent is hereby corrected as shown below:

Column 9, Line 41 "hi-deck" should be b -- bi-deck --

Column 20, Line 37 "said flexible" should be -- said upper deck can move upwardly or downwardly along said flexible --

Column 21, Line 12 "lower towards" should be -- lower deck towards --

Column 22, Line 42 "and" should be --end-- (second occurrence)

Column 23, Line 31 "said which" should be -- said lower deck, said windows in said decks allowing light which --

Column 20, Line 19 "direction, lower" should be -- direction, said lower --

Column 22, Line 41 after "one" should be --said--.

Signed and Sealed this

Twenty-first Day of July, 1998

Bruce Lehman

*Attest:*

BRUCE LEHMAN

*Attesting Officer*

*Commissioner of Patents and Trademarks*